US008184814B2

(12) United States Patent
Cvetkovic

(10) Patent No.: US 8,184,814 B2
(45) Date of Patent: May 22, 2012

(54) AUDIO SIGNAL PROCESSING METHOD AND SYSTEM

(75) Inventor: Zoran Cvetkovic, London (GB)

(73) Assignee: King's College London, London (GB)

( * ) Notice: Subject to any disclaimer, the term of this patent is extended or adjusted under 35 U.S.C. 154(b) by 854 days.

(21) Appl. No.: 12/094,593

(22) PCT Filed: Nov. 24, 2006

(86) PCT No.: PCT/GB2006/004393

§ 371 (c)(1),
(2), (4) Date: Oct. 28, 2008

(87) PCT Pub. No.: WO2007/060443

PCT Pub. Date: May 31, 2007

(65) Prior Publication Data

US 2009/0225993 A1 Sep. 10, 2009

(30) Foreign Application Priority Data

Nov. 24, 2005 (GB) ..... 0523946.2

(51) Int. Cl.
*H04R 5/00* (2006.01)

(52) U.S. Cl. ..... 381/26; 381/56; 381/58; 381/92; 381/94.8; 381/122

(58) Field of Classification Search ..... 381/26, 381/56, 58, 92, 94.8, 122
See application file for complete search history.

(56) References Cited

U.S. PATENT DOCUMENTS 5,627,899 A * 5/1997 Craven et al. ..... 381/98
6,760,451 B1 * 7/2004 Craven et al. ..... 381/98
7,212,956 B2 * 5/2007 Bruno et al. ..... 702/190
7,876,914 B2 * 1/2011 Grosvenor et al. ..... 381/92
2004/0096066 A1 * 5/2004 Metcalf ..... 381/26
2004/0223620 A1 * 11/2004 Horbach et al. ..... 381/59
2006/0126852 A1 * 6/2006 Bruno et al. ..... 381/17
2006/0167963 A1 * 7/2006 Bruno et al. ..... 708/300

OTHER PUBLICATIONS

Ajdler et al., "The Pleanacoustic function, sampling and reconstruction," 2003 IEEE International Conference on Acoustics, Speech and Signal Processing; vol. 1, pp. V616-V619 (Apr. 6, 2003).

Coda, International Search Report and Written Opinion for PCT/GB2006/004393 (Oct. 5, 2007).

*Forum, Recording Concert Hall Acoustics for Posterity*; Michael A. Gerzon, Mathematical Institute, University of Oxford, Oxford, England, Sep. 1975, vol. 23, No. 7, pp. 569-571.

*Recording Concert Hall Acoustics for Posterity*; Angelo Farina, Regev Ayalon, Audio Engineering Society 24th International Conference on Multichannel Audio, 2003, 14 pages.

* cited by examiner

*Primary Examiner* — Victor A Mandala

(74) *Attorney, Agent, or Firm* — Klarquist Sparkman, LLP

(57) ABSTRACT

The invention makes use of impulse responses of the performance venue to process a recording or other signal so as to emulate that recording having being recorded in the performance venue. In particular, by measuring or calculating the impulse responses of a performance venue such as an auditorium between an instrument location within the venue and one or more soundfield sampling locations, it then becomes possible to process a "dry" signal, being a signal which has little or no reverberation or other artifacts introduced by the location in which it is captured (such as, for example, a close microphone studio recording) with the impulse response or responses so as to then make the signal seem as if it was produced at the instrument location in the performance venue, and captured at the soundfield sampling location.

12 Claims, 17 Drawing Sheets

| $L_h$ – | 1700 | |
|---|---|---|
| *Training Sequence* | 400000 *samples* | |
| $L_g$ | 1700 | |
| $Energy_{Average}$ | −33.8dB | −26.8dB |
| $MSE$ | −47.5dB | −43.9dB |
| *Relative Error* | −13.7dB | −17.1dB |

Table 1

| $L_h$ | 1700 | |
|---|---|---|
| $FFTSize$ | $2 * FFTSize_{Min}$ | |
| $L_g$ | 15302 | |
| $Energy_{Average}$ | −33.8dB | −26.8dB |
| $MSE$ | −98.2dB | −82.1dB |
| *Relative Error* | −64.4dB | −55.3dB |

Table 2

| $L_h$ | 1700 | | |
|---|---|---|---|
| *Training Sequence* | 600000 *samples* | | |
| $L_g$ | 1700 | | |
| $Energy_{Average}$ | −28.2dB | −33.8dB | −26.8dB |
| $MSE$ | −41.2dB | −45.7dB | −36.9dB |
| *Relative Error* | −13dB | −11.9dB | −10.1dB |

Table 3

| $L_h$ | 1700 | | |
|---|---|---|---|
| $FFTSize$ | $2 * FFTSize_{Min}$ | | |
| $L_g$ | 22102 | | |
| $Energy_{Average}$ | −28.2dB | −33.8dB | −26.8dB |
| $MSE$ | −111.9dB | −109.1dB | −98.8dB |
| *Relative Error* | −83.7dB | −75.3dB | −72dB |

Table 4

Figure 18

| $FFTSize$ | $RelativeError$ | |
|---|---|---|
| $2 * FFTSize_{Min}$ | $-64.4$dB | $-55.3$dB |
| $4 * FFTSize_{Min}$ | $-96.9$dB | $-89.1$dB |
| $8 * FFTSize_{Min}$ | $-130.2$dB | $-123.1$dB |
| $10 * FFTSize_{Min}$ | $-176.5$dB | $-170.1$dB |

Table 5

| $FFTSize$ | $RelativeError$ | | |
|---|---|---|---|
| $2 * FFTSize_{Min}$ | $-83.7$dB | $-75.3$dB | $-72$dB |
| $4 * FFTSize_{Min}$ | $-122.1$dB | $-121.3$dB | $-119.9$dB |
| $8 * FFTSize_{Min}$ | $-180.9$dB | $-179.8$dB | $-170.8$dB |
| $10 * FFTSize_{Min}$ | $-227.5$dB | $-220.9$dB | $-212.3$dB |

Table 6

Figure 19

AUDIO SIGNAL PROCESSING METHOD AND SYSTEM

CROSS REFERENCE TO RELATED APPLICATIONS

This is a 35 U.S.C. §371 U.S. National Stage of International Application No. PCT/GB2006/004393, filed Nov. 24, 2006, which was published in English under PCT Article 21(2), which in turn claims the benefit of United Kingdom Application No. 0523946.2, filed Nov. 24, 2005. Both applications are incorporated herein in their entirety.

TECHNICAL FIELD

The present invention relates to an audio signal processing method and system.

BACKGROUND TO THE INVENTION AND PRIOR ART

Following the advent of multichannel audio, a five-channel audio technology has been recently proposed that attempts to reproduce some or most of the auditory experience of an acoustic performance in its original venue, as described in U.S. Pat. No. 6,845,163, and Johnston J. D. and Lam Y. H., "Perceptual Soundfield Reconstruction", 109$^{th}$ AES Convention, paper No. 5202, September 2000. The audio scheme uses a specially constructed seven-channel microphone array to capture cues needed for reproduction of the original perceptual soundfield in a five-channel stereo system. The microphone array consists of five microphones in the horizontal plane, as shown in FIG. 1, placed at the vertices of a pentagon, and two additional microphones laying in the vertical line in the center of the pentagon, one pointing up the other down.

The seven audio signals captured by the microphone array are mixed down to five reproduction channels, front-left (FL), frontcenter (FC), front-right (FR), rear-left (RL), and rear-right (RR), as shown in FIG. 2. Listening tests demonstrated significant increase of the "sweet spot" area of the new scheme compared to the standard two-channel audio in terms of sound-source localization.

It is also known in the field of multi-channel audio to reproduce a signal split into its separate "direct" and "diffuse" components, the direct components being those components received directly at a listener from a sound source plus several early reflections, the diffuse components then being the following components, which will typically be the reverberant components. Such a scheme is described in Rosen G. L and Johnston J. D. "*Automatic Speaker Directivity Control For Soundfield Reconstruction*", presented at the 19$^{th}$ AES International Conference, Schloss Elmau, Germany, 21-24 Jun. 2001. In this paper it is described how the direct components may be reproduced by a first speaker, and the diffuse components reproduced by a second speaker using a diffuser panel.

SUMMARY OF THE INVENTION

Within the context of a microphone array similar to the type mentioned above the present inventors have noted that each microphone receives the source sound filtered by the corresponding impulse response of the performance venue between the source and the microphone. The impulse response consists of two parts: direct, which contains the impulse which travels to the microphone directly plus several early reflections, and reverberant, which contains impulses which are reflected multiple times. The soundfield component which is obtained by convolving the source sound with the direct part of the impulse response creates the so-called direct soundfield, that carries perceptual cues relevant for source localization, while the component which is the result of the convolution of the source sound with the reverberant part of the impulse response creates the diffuse soundfield, which provides the envelopment experience.

In view of such an analysis the present inventors have noted that it should be possible to make use of the impulse responses of the performance venue to process a recording or other signal so as to emulate that recording having being recorded in the performance venue, and for example although not exclusively as if recorded by the prior art Johnston microphone array. In particular, by measuring or calculating the impulse responses of a performance venue such as an auditorium between an instrument location within the venue and one or more soundfield sampling locations, it then becomes possible to process a "dry" signal, being a signal which has little or no reverberation or other artifacts introduced by the location in which it is captured (such as, for example, a close microphone studio recording) with the impulse response or responses so as to then make the signal seem as if it was produced at the instrument location in the performance venue, and captured at the soundfield sampling location. Preferably a plurality of soundfield sampling locations are used, and the soundfield sampling locations are even more preferably chosen so as to be perceptually significant such as, for example, those of the Johnston microphone array, although other arrays may also be used. By using a plurality of soundfield sampling locations then multiple output signals can be produced, which can then be used as inputs to a multi-channel surround sound system.

In view of the above, from a first aspect the present invention provides an audio signal processing method comprising:— obtaining one or more impulse responses, each impulse response corresponding to the impulse response between a single sound source location and a single soundfield sampling location;

receiving an input audio signal; and processing the input audio signal with at least part of the one or more impulse responses to generate one or more output audio signals, the processing being such as to emulate within the output audio signal the input audio signal as if located at the sound source location.

Preferably, a plurality of impulse responses are obtained, corresponding to the impulse responses between at least one sound source location and a plurality of soundfield sampling locations. In such a case, preferably a plurality of output signals are generated, and more preferably at least one output signal per soundfield sampling location is produced.

From another aspect the present invention provides an audio signal processing method comprising:

obtaining a plurality of audio signals by sampling a soundfield at a plurality of soundfield sampling locations, the soundfield being caused by a sound source producing a source signal; and processing the plurality of audio signals to obtain the source signal.

With such an aspect it becomes possible to perform essentially the reverse processing of the first aspect i.e. to obtain the substantially dry signal from the multi channel in situ recording.

A third aspect of the invention provides an audio signal processing system comprising:— a memory for storing, at least temporarily, one or more impulse responses, each impulse response corresponding to the impulse response between a single sound source location and a single soundfield sampling location;

an input for receiving an input audio signal; and a signal processor arranged to process the input audio signal with at least part of the one or more impulse responses to generate one or more output audio signals, the processing being such as to emulate within the output audio signal the input audio signal as if located at the sound source location.

Within the third aspect preferably, a plurality of impulse responses are obtained, corresponding to the impulse responses between at least one sound source location and a plurality of soundfield sampling locations. In such a case, preferably a plurality of output signals are generated, and more preferably at least one output signal per soundfield sampling location is produced.

A fourth aspect of the invention further provides an audio signal processing system comprising:

an input for receiving a plurality of audio signals by sampling a soundfield at a plurality of soundfield sampling locations, the soundfield being caused by a sound source producing a source signal; and a signal processor arranged to process the plurality of audio signals to obtain the source signal Further aspects and preferential features of the invention will be apparent from the appended claims.

BRIEF DESCRIPTION OF THE DRAWINGS

Further features and advantages of the present invention will become apparent from the following description of embodiments thereof, presented by way of example only, and by reference to the accompanying drawings, wherein like reference numerals refer to like parts, and wherein:—

FIG. 18 is a first set of tables illustrating results obtained from the fourth embodiment of the invention; and FIG. 19 is a second set of tables illustrating results obtained from the fourth embodiment of the invention

DESCRIPTION OF THE EMBODIMENTS

Figure 2:
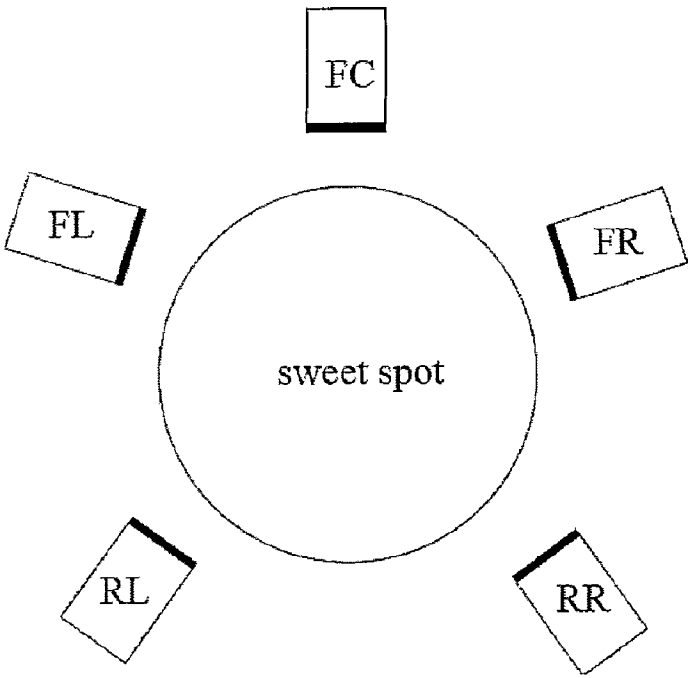
FIG. 2 is a drawing illustrating the arrangement of speakers for reproducing output audio signals in embodiments of the present invention.
Figure 1:
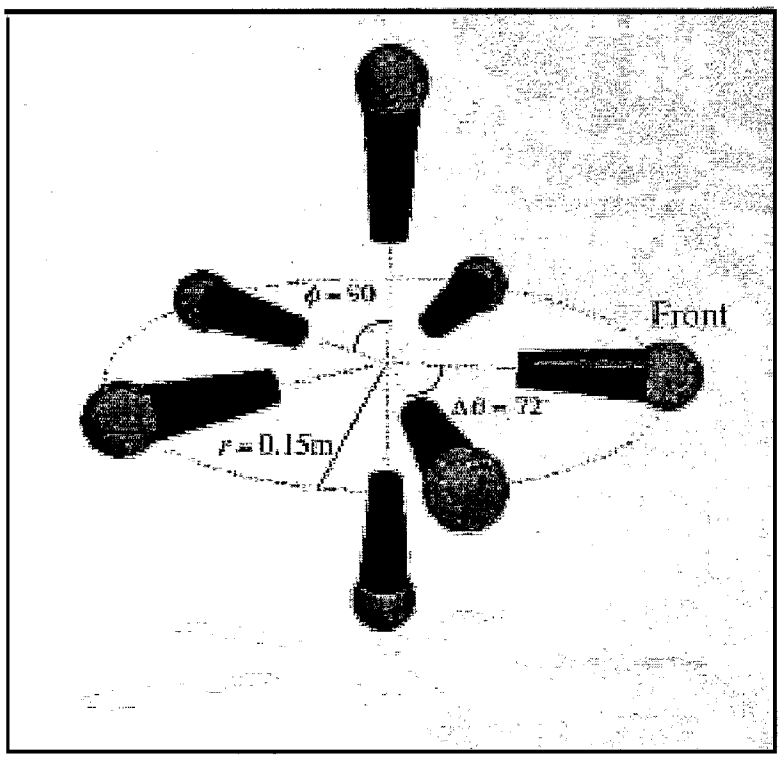
FIG. 1 is an illustration showing the arrangement of the prior art Johnston Microphone Array.

Several embodiments of the invention representing non-limiting examples will now be described.

First Embodiment

Coherent Emulation

A first embodiment of the invention will now be described.

The signals captured by a recording microphone array can be completely specified by a corresponding set of impulse responses characterizing the acoustic space between the sound sources and the microphone array elements. Hence it should be possible to achieve a convincing emulation of a music performance in a given acoustic space by convolving dry studio recordings with this set of impulse responses of the space. In the first embodiment we make use of this concept and refer to it as coherent emulation, since playback signals are created in a manner which is coherent with the sampling of a real soundfield. The theoretical background to the first embodiment is as follows.

Consider recording a performance in an auditorium. The signal xi(t), produced by an instrument on the stage, is captured by a microphone j of the recording array as $$y_{j,i}(t) = \int_{-\infty}^{\infty} x_i(\tau) h_{i,j}(t-\tau)\, d\tau \qquad \text{Eq. 1}$$

where hi,j(t) is the impulse response of the auditorium between the location of the instrument i and the microphone j. Note that this impulse response depends both on the auditorium and on the directivity of the microphone. The composite signal captured by microphone j is $$y_j(t) = \sum_{i=1}^{N} \int_{-\infty}^{\infty} x_i(\tau) h_{i,j}(t-\tau)\, d\tau \qquad \text{Eq. 2}$$

where xi(t), i=1, 2, . . . , N are the dry sounds of individual instruments (or possibly groups of instruments, e.g. first violins) with distinct locations in the auditorium. We consider a scheme in which all the elements of the sampling array are situated in the horizontal plane, and the sound is played back using speakers which are all also in the horizontal plane. The speakers are positioned in a geometry similar to that of the sampling array except for a difference in scale. For such a sampling/playback setup mixing of the signals yj(t) would adversely effect the emulated auditory experience. Coherent emulation of a music performance in a given acoustic space is achieved by generating playback signals yj(t) by convolving xi(t), obtained using close microphone studio recording techniques, with impulse responses hi,j(t) which correspond to the space. Impulse responses hi,j(t) can be measured in some real auditoria, or can be computed analytically for some hypothetical spaces (as described by Allen et al "Image method for efficiently simulating small-room acoustics", JASA, Vol. 65, No. 4, pp. 934-950, April 1979, and Peterson, "Simulating the response of multiple microphones to a single acoustic source in a reverberant room", JASA, Vol. 80, No. 5, pp 1527-1529, May 1986). This basic form of coherent emulation approximates instruments by point sources, however, the scheme can be refined by representing each instrument by a number of point sources, by modelling instrument directivity, and in many other ways. Note, for the effectiveness of this emulation concept, it is important that impulse responses hi,j(t) used correspond to a sampling scheme that captures cues necessary for satisfactory perceptual soundfield emulation. For example, the sampling locations may be arranged to take into account human perceptual factors, and hence may be arranged to take into account the soundfield around the shape of a human head. The microphone array of Johnston meets this criteria, but as discussed later below, many other sampling location arrangements can also be used.

Figure 4:
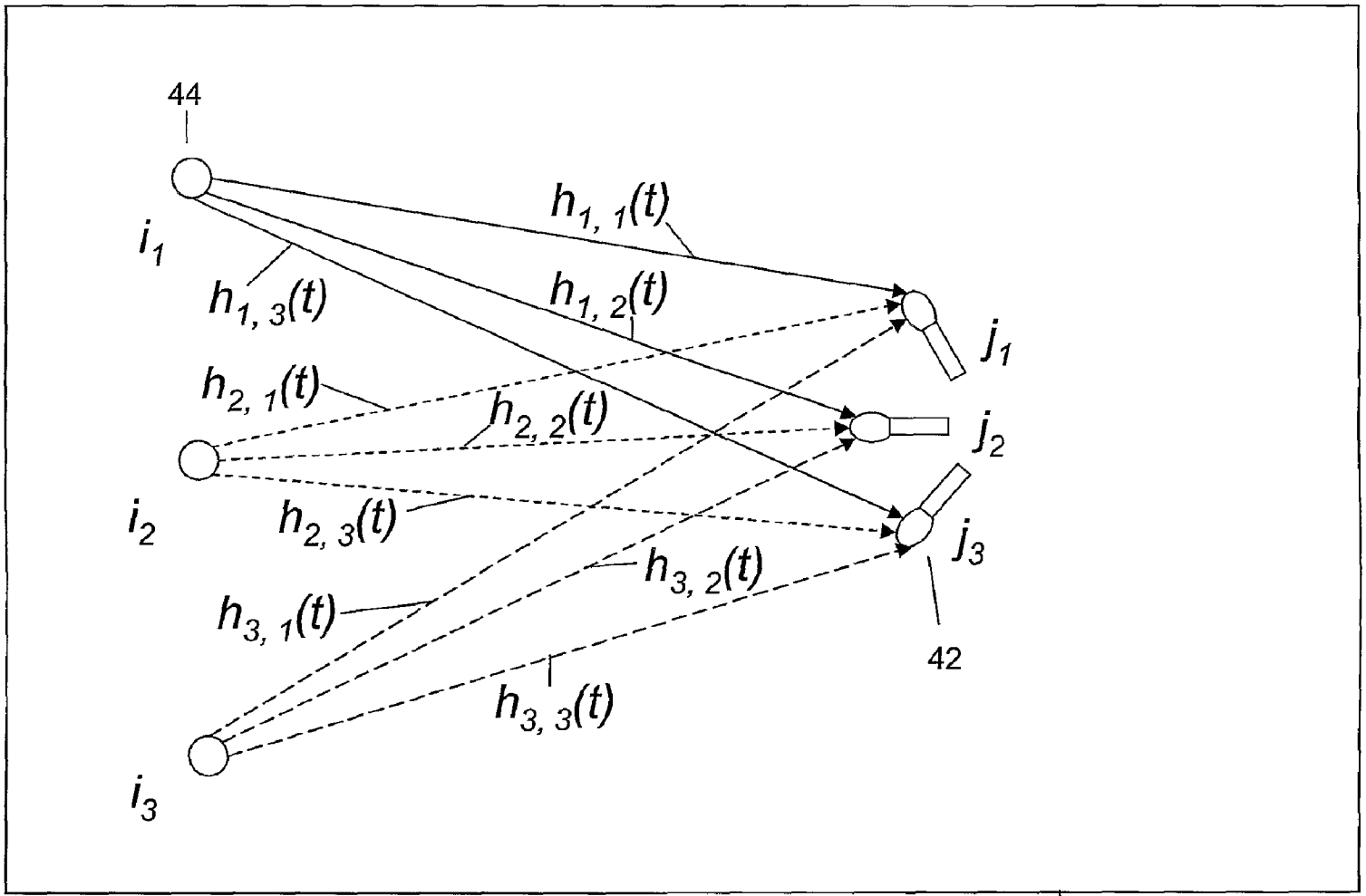
FIG. 4 is a drawing illustrating impulse responses in a room between three sound sources and three soundfield sampling locations.

An embodiment exemplifying the above described processing will now be described with respect to FIGS. 4 to 6. In particular, FIG. 4 is a diagram illustrating the various impulse responses produced within a performance venue such as a room 40 by a plurality of instruments 44, sampled at a plurality of soundfield sampling locations 42. In particular, FIG. 4 illustrates three sound source locations i1, i2, and i3, and three soundfield sampling locations j1, j2, and j3. As will be seen, a total of nine impulse responses can be measured with such an arrangement being responses h1,1(*t*), h1,2(*t*), and h1,3(*t*) being the impulse responses between location i1 and the three soundfield sampling locations, impulse responses h2,1(*t*), h2,2(*t*), and h2,3(*t*) being the impulse responses between location i2 and the three soundfield sampling locations, and impulse responses h3,1(*t*), h3,2(*t*), and h3,3(*t*) between the location i3, and soundfield locations j1, j2, and j3 respectively. It should be noted that whilst in the presently described embodiment we describe by way of example the use of three soundfield sampling locations j1, j2, and j3, and three sound source locations i1, i2, and i3, in other embodiments of the invention more or less soundfield sampling locations, as well as sound source locations may be used. In preferred embodiments of the invention at least five soundfield sampling locations are used, and as many sound source locations as are required.

Figure 5:
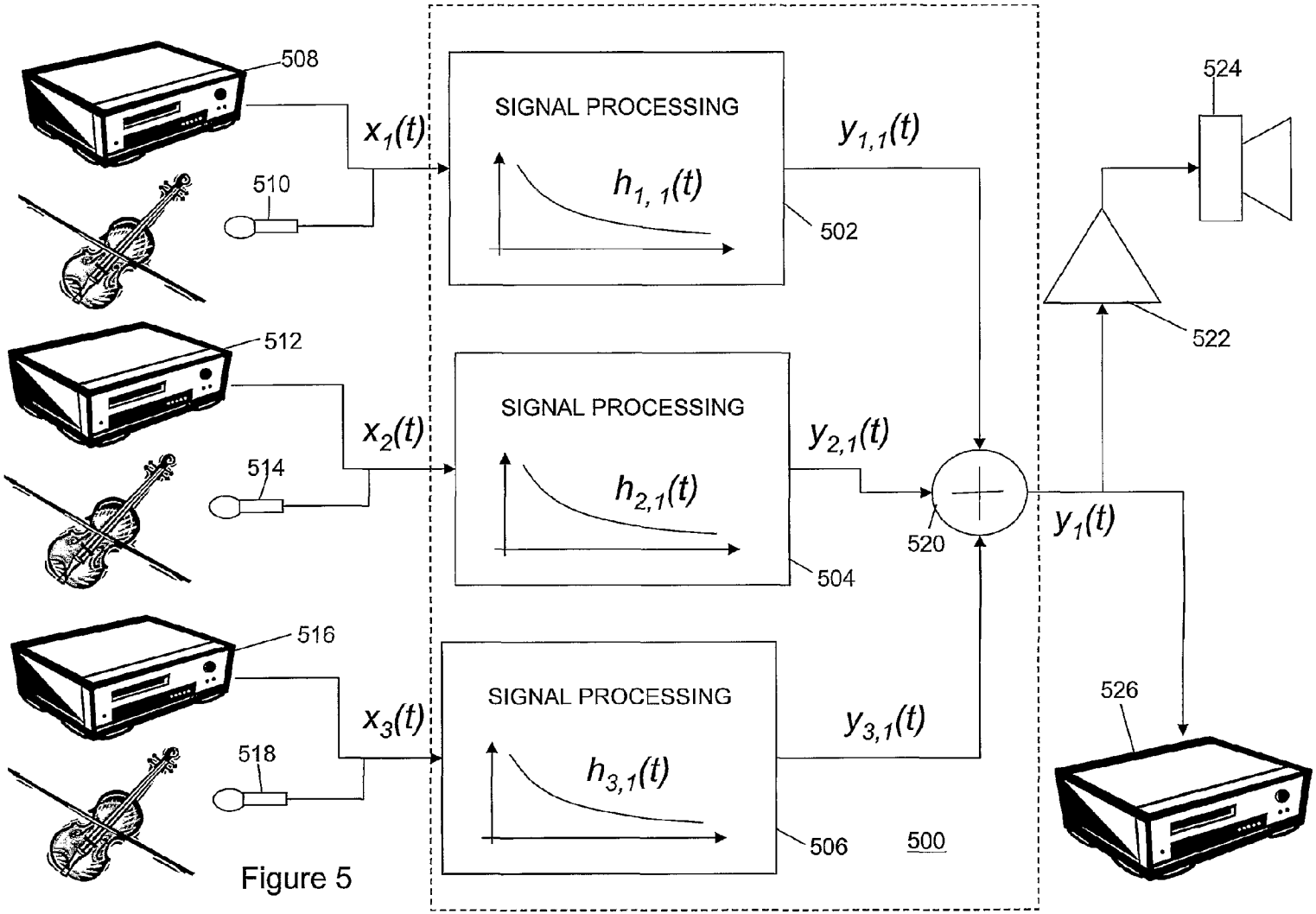
FIG. 5 is a block diagram of a part of a first embodiment of the present invention.

With the above described impulse responses in mind, FIG. 5 illustrates a part of a system of the first embodiment, which can be used to process input signals so as to cause those signals to appear as if they were produced at one of the sound source locations i1, i2, or i3. In particular, FIG. 5 illustrates in functional block diagram form a signal processing block 500 which is used to produce a single output signal in the first embodiment. In particular, within the first embodiment as many output signals are produced as there are soundfield sampling locations, and hence a signal processing block 500 is provided for each soundfield sampling location, as shown in FIG. 6. In this case, a signal processing block 500 is provided corresponding to soundfield sampling location j1, referred to as the right channel signal processing means 602, another signal processing block 500 is provided for the soundfield sampling location j2, referred to in FIG. 6 as the centre channel signal processing means 604, and, finally, another signal processing block 500 is provided for the soundfield sampling location j3, shown in FIG. 6 as the left channel signal processing means 606.

Figure 6:
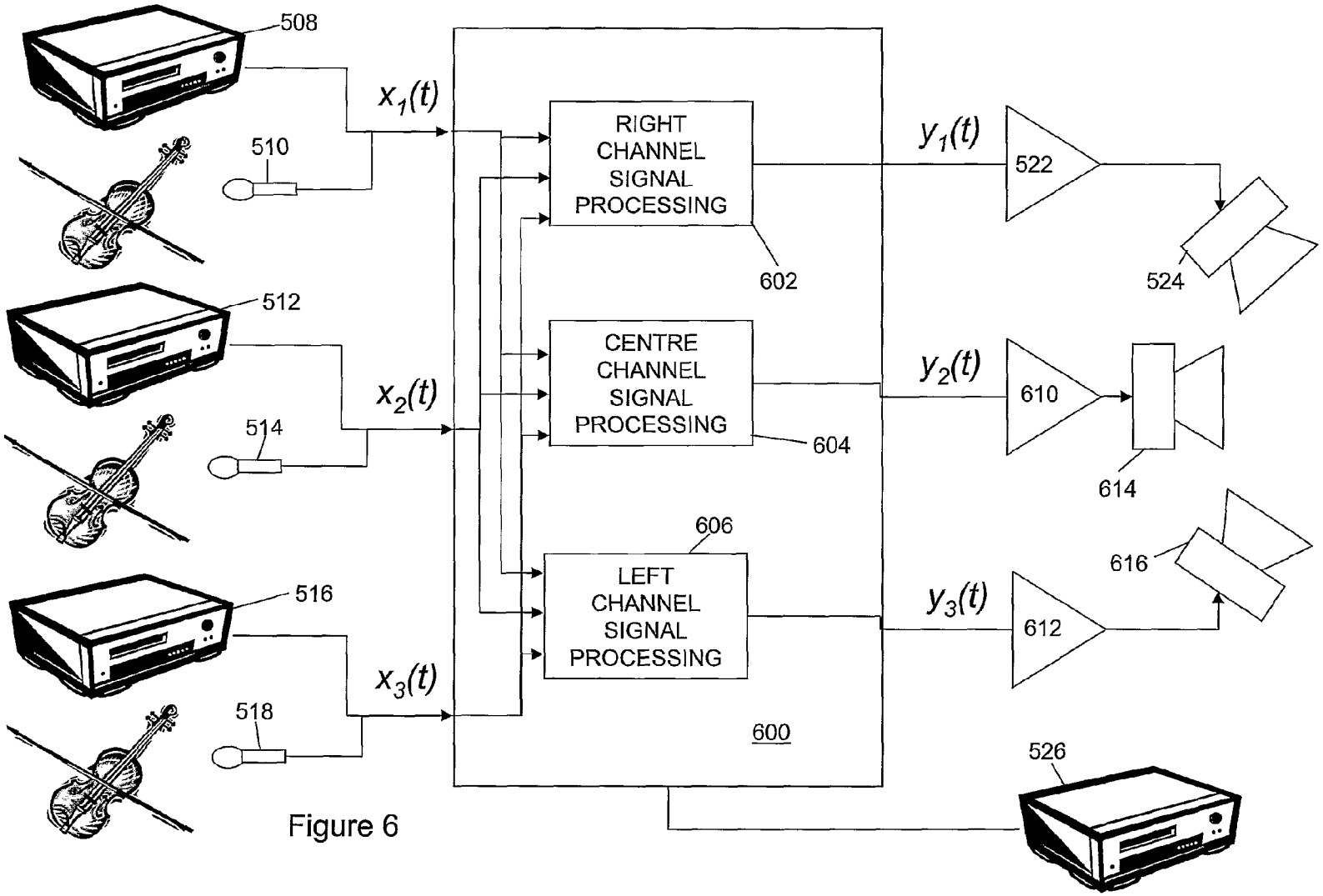
FIG. 6 is a block diagram of a first embodiment of the present invention.

Referring back to FIG. 5, the signal processing block 500 shown therein corresponds to the right channel signal processing means 602 of FIG. 6, and is intended to produce an output signal for output as the right hand channel in a three channel reproducing system. In this regard, the signal processing block 500 corresponds to the soundfield sampling location j1, as discussed. Contained within the signal processing block 500 are three internal signal processing means 502, 504, and 506, being one signal processing means for each input signal which is to be processed. Thus, in other embodiments where there are more or less input signals to be processed, then the same number of internal signal processing means 502, 504, and 506 will be provided as the number of input signals.

Recall that the purpose of the first embodiment is to process "dry" input signals, being signals which are substantially devoid of artifacts introduced by the acoustic performance of the environment in which the signal is produced, and which will commonly be close mic studio recordings, so as to make those signals appear as if they have been recorded from a specific location i1, i2, i3, . . . , in within a performance venue, the recording having taken place from a soundfield sampling location j1, j2, j3, . . . , jn. In the presently described example, three sound source locations i1, i2, and i3, are being used, which assumes that there are three separate audio input signals corresponding to three instruments, or groups of instruments. Firstly, therefore, it is necessary to assign each instrument or group of instruments to one of the locations i1, i2, and i3. In this example, assume that signal x1(*t*) is allocated to location i1, signal x2(*t*) is allocated to position i2, and signal x3(*t*) is allocated to position i3. Signal x1(*t*) may be obtained from a recording reproduced by a reproducing device 508 such as a tape machine, CD player, or the like, or may be obtained via a close mic 510 capturing a live performance. Similarly, signal x2(*t*) may be obtained by a reproducing means 512 such as a tape machine, CD player, or the like, or alternatively via a close mic 514 capturing a live performance. Similarly, x3(*t*) may be obtained from a reproducing means 516, or via a live performance through close mic 518.

Howsoever the input signals are captured or reproduced, the first input signal x1(*t*) is input to the first internal signal processing means 502. The first internal signal processing means 502 contains a memory element which stores a representation of the impulse response between the assigned location for the first input signal, being i1 and the soundfield sampling location which the signal processor block 500 represents, being j1. Therefore, the first internal signal processing means 502 stores a representation of impulse response h1,1(*t*). The internal signal processing means 502 also receives the first input signal x1(*t*), and acts to convolve the received input signal with the stored impulse response, in accordance with equation 1 above. This convolution produces the first output signal y1,1(*t*), which is representative of the component of the soundfield which would be present at location j1, caused by input signal x1(*t*) as if x1(*t*) is being produced at location i1. First output signal y1,1(*t*) is fed to a first input of a summer 520.

Similar processing is also performed at second and third internal signal processing means 504 and 506. Second internal signal processing means 504 receives as its input second input signal x2(*t*), which is intended to be emulated as if at position i2 in room 40. Therefore, second internal signal processing means 504 stores a representation of impulse response h2,1(*t*), being the impulse response between location i2, and soundfield sampling location j1. Then, second internal signal processing means 504 acts to convolve the received input signal x2(*t*) with impulse response h2,1(*t*), again in accordance with equation 1, to produce convolved output signal y2,1(*t*). The output signal y2, 1(*t*) therefore represents the component of the soundfield at location j1 which is caused by the input signal x2(*t*) as if it was at location i2 in room 40. Output signal y2,1(*t*) is input to a second input of summer 520.

With regard to third internal signal processing means 506, this receives input signal x3(*t*), which is intended to be emulated as if at location i3 in room 40. Therefore, third internal signal processing means 506 stores therein a representation of impulse response h3,1(*t*), being the impulse response between location i3, and soundfield sampling location j1. Third internal signal processing means 506 then convolves the received input signal x3(*t*) with the stored impulse response, to generate output signal y3,1(*t*), which is representative of the soundfield component at sampling location j1 caused by signal x3(*t*) as if produced at location i3. This third output signal is input to a third input of the summer 520.

The summer 520 then acts to sum each of the received signals y1,1(*t*), y2,1(*t*), and y3,1(*t*), into a combined output signal y1(*t*). This output signal y1(*t*) represents the output signal for the channel corresponding to soundfield sampling location j1, which, as shown in FIG. 6, is the right channel. Signal y1(*t*) may be input to a recording apparatus 526, such as a tape machine, CD recorder, DVD recorder, or the like, or may alternatively be directed to reproducing means, in the form of a channel amplifier 522, and a suitable transducer such as a speaker 524.

It will be appreciated from the above that the signal processing block 500 of FIG. 5 represents the processing that is performed to produce an output signal corresponding to one of the soundfield sampling locations only, being the soundfield sampling location j1. As shown in FIG. 6, in order to produce an output signal for each of the soundfield sampling locations signal processor 600 is provided with sampling blocks 602, 604, and 606 which act to produce output signals for the right channel, centre channel, and left channel, accordingly. As mentioned previously, processing block 500 of FIG. 5 is represented in FIG. 6 by the right channel signal processing means 602. The centre channel and left channel signal processing means 604 and 606 are therefore substantially identical to the signal processing block 500 of FIG. 5, and each receive the input signals x1(*t*), x2(*t*), and x3(*t*), as shown. Similarly, each of the centre channel and left channel signal processing means 604 and 606 contain internal signal processing means of the same number as the number of input signals received, i.e. in this case three. Each of those internal signal processing means, however, differ in terms of the specific impulse response which is stored therein, and which is applied to the input signal to convolve the input signal with the impulse response. Therefore, the centre channel signal processing means 604 which represents soundfield sampling location j2 has a first internal signal processing means which stores impulse response h1,2(*t*) and which processes input signal x1(*t*) to produce output signal y2,2(*t*), a second internal signal processing means which stores impulse response h2,2(*t*), and which processes input signal x2(*t*) to produce output signal y2,2(*t*), and a third internal signal processing means which stores impulse response h3,2(*t*), and which processes input signal x3(*t*), to produce output signal y3,2(*t*). The three output signals y1,2(*t*), y2,2(*t*), and y3,2(*t*), are input into a summer, which combines the three signals to produce output signal y2(*t*), which is the centre channel output signal. The centre channel output signal can then be output by a reproducing means comprising a channel amplifier and a suitable transducer such as a speaker, or alternatively recorded by a recording means 526.

Likewise, the left channel signal processing means 606 comprises three internal signal processing blocks each of which act to receive a respective input signal, and to store a respective impulse response, and to convolve the received input signal with the impulse response to generate a respective output signal. In particular, the first internal signal processing means stores the impulse response h1,3(*t*), and processes input signal x1(*t*) to produce output signal y1,3(*t*). Likewise, the second internal signal processing block stores impulse response h2,3(*t*), receives input signal x2(*t*), and produces output signal y2,3(*t*). Finally, the third internal signal processing block stores impulse response h3,3(*t*), receives input signal x3(*t*), and outputs output signal y3,3(*t*). The three output signals are then summed in a summer, to produce left channel output signal y3(*t*). This output signal may be reproduced by a channel amplifier and transducer which is preferably a speaker, or recorded by a recording means 526.

When the three output signals are reproduced by their respective transducers, preferably the transducers are spatially arranged so as to correspond to the spatial distribution of the soundfield sampling locations j1, j2, and j3 to which they correspond. Therefore, as shown in FIG. 4, sound field sampling locations j1, j2, and j3, are substantially equidistantly and equiangularly spaced about a point, and hence during reproduction the respective speakers producing the output signal corresponding to each sound field sampling location should also have such a spatial distribution. A speaker spatial distribution as shown in FIG. 2, where a five channel output is obtained, is particularly preferred.

The effect of the operation of the first embodiment is therefore to obtain output signals which can be recorded, and which when reproduced by an appropriately distributed multichannel speaker system give the impression of the recordings have been made within room 40, with the instrument or group of instruments producing source signal x1(*t*) being located at location i1, the instrument or group of instruments producing source signal x2(*t*) being located at position i2, and the instrument or group of instruments producing source signal x3(*t*) being located at position i3. Using the first embodiment of the present invention therefore allows two acoustic effects to be added to dry studio recordings. The first is that the recordings can be made to sound as if they were produced in a particular auditorium, such as a particular concert hall such as the Albert Hall, Carnegie Hall, Royal Festival Hall, or the like, and moreover from within any location within such a performance venue. This is achieved by obtaining impulse responses from the particular concert halls in question at the location at which the recordings are to be emulated, and then using those impulse responses in the processing. The second effect which can be obtained is that the apparent location of instruments producing the source signals can be made to vary, by assigning those instruments to the particular available source locations. Therefore, the apparent locations of particular instruments or groups of instruments corresponding to the source signals can be changed from each particular recording or reproducing instruments. For example, in the embodiment described above source signal x1(*t*) is located at location i1, but in another recording or reproducing instance this need not be the case, and, for example, x1(*t*) could be emulated to come from location i2, and source signal x2(*t*) could be emulated to come from location i1. Other combinations are of course possible. Therefore, in the method and system according to the first embodiment, input signals can be processed so as to emulate different locations of the instruments or groups of instruments producing the signals within a concert hall, and to emulate the acoustics of different concert halls themselves.

Figure 3:
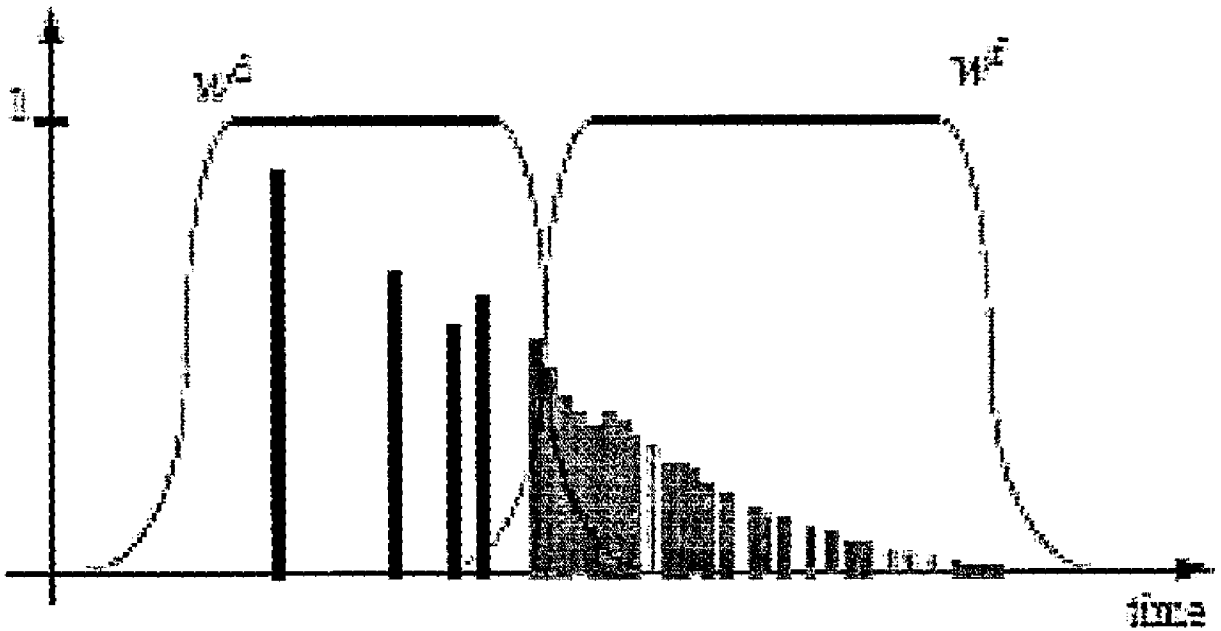
FIG. 3 is a plot of a typical impulse response.

Concerning obtaining the impulse responses required, these can be measured within the actual concert hall which it is desired to emulate, for example by generating a brief sound impulse at the location i, and then collecting the sound with a microphone located at desired soundfield sampling location j. Other impulse response measurement techniques are also known, which may be used instead. An example of such an impulse response which can be collected is shown in FIG. 3. Alternatively, for relatively simple room designs and with known material properties, it is known to be able to theoretically calculate an impulse response, as mentioned above. It should be noted that the location of the soundfield sampling locations j within any particular performance venue can be varied as required. For example, in some embodiments it may be preferable to choose soundfield sampling locations j which correspond to locations within the performance venue which are thought to have particularly good acoustics. By obtaining the impulse responses to these good locations then emulation of recordings at such locations can be achieved.

Another variable factor within the first embodiment is the spatial distribution of the soundfield sampling locations. As an example distribution, the soundfield sampling locations may be distributed as in the prior art Johnston array, with, in a five channel system, five microphones equiangularly and equidistantly spaced about a point, and arranged in a horizontal plane. The Johnston array appears to be beneficial because it takes into account psycho acoustic properties such as inter-aural time difference, and inter-aural level difference, for a typically sized human head. However, the inventors have found that the particular distribution of the sampling soundfield locations according to the Johnston array is not essential, and that other soundfield sampling location distributions can be used. For example, although preferably the sampling soundfield locations should all be located in the same horizontal plane, and are preferably, although not exclusively, equiangularly spaced at that point, the diameter of the spatial distribution can vary from the 31 cm proposed by Johnston without affecting the performance of the arrangement dramatically. In fact, the present inventors have found that a larger diameter is preferable, and in perception tests using arrays ranging in size from 2 cm, to 31 cm, to 1.24 m, to 2.74 m, the larger diameter array was found to give the best results. Moreover, these diameters are not intended to be limiting, and even larger diameters may also be used. That is, the sampling distribution is robust to the size of the diameter of the distribution, and at present no particularly optimal distribution has yet being found. It should also be mentioned that the soundfield sampling locations do not need to be circularly distributed around a point, and that other shape distributions are possible. Moreover, preferably each soundfield sampling location directionally samples the soundfield, although the directionality of the sampling is preferably such that overlapping soundfield portions are captured by adjacent soundfield sampling locations. Further aspects of the distribution of the soundfield sampling locations and the directionality of the sampling are described in the paper Hall and Cvetkovic, "*Coherent Multichannel Emulation of Acoustic Spaces*" presented at the ABS 28$^{th}$ International Conference, Pitea, Sweden, 30 Jun.-2 Jul. 2006, any details of which necessary for understanding the present invention being incorporated herein by reference.

Additionally, within the above described embodiment we use the example of three soundfield sampling locations, although it should be understood that within embodiments of the invention more or less soundfield sampling locations can be used. However, following the findings of Fletcher in *The ASA Edition of Speech and Hearing in Communication* ed J. B. Allen, Acoustical Society of America, 1995 that satisfactory reconstruction in the horizontal plane in front of a listener requires at least three independent channels it is preferable, although not essential, that at least three soundfield sampling locations are used. In preferred embodiments at least five soundfield sampling locations would be used, to provide at least five output channels, and in other embodiments even more such soundfield sampling locations could be used to provide more independent channels. It is also readily possible to envisage that more soundfield sampling locations are used than the number of output channels requires. In such a case some mixing of signals produces from each soundfield sampling location, either before or after processing with the impulse responses, can be envisaged to produce the required number of output signals. Alternatively, instead of mixing, some of the signals obtained from the soundfield sampling locations could be considered redundant, and their signals not used.

Second Embodiment

Coherent Emulation with Direct and Diffuse Soundfield Separation

A second embodiment of the present invention will now be described, which splits the impulse responses into direct and diffuse responses, and which produces separate direct and diffuse output signals.

Figure 11:
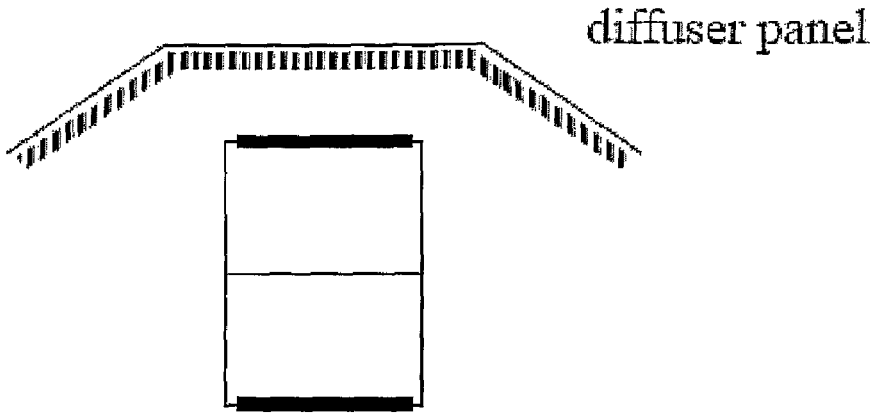
FIG. 11 is a drawing of a second speaker arrangement which can be used for reproducing output signals produced by the second embodiment of the present invention.
Figure 10:
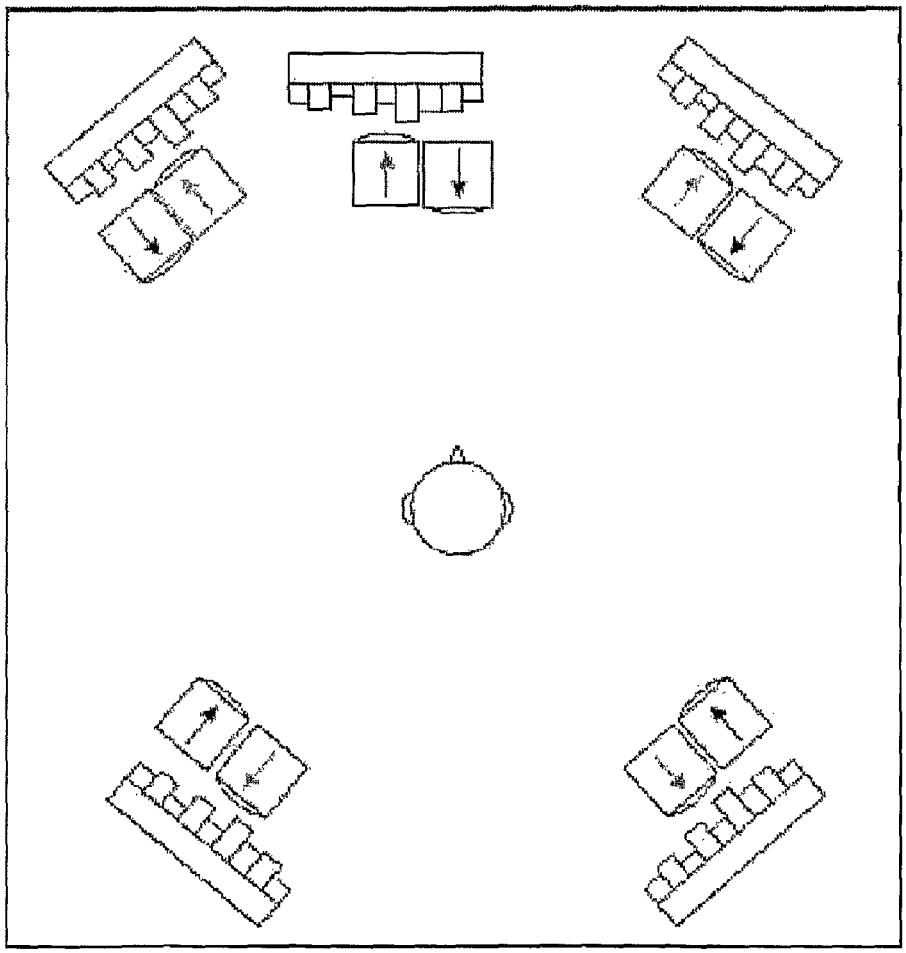
FIG. 10 is a drawing of a speaker arrangement for reproducing output signals produced by the second embodiment of the present invention.

The reproduction using only five speakers, whilst good, may not provide a totally satisfactory envelopment experience since five reproduction channels may not be sufficient to produce adequate diffusion of the soundfield. Additionally, recreation of the diffuse soundfield using the same speaker elements which are used for recreation of the direct soundfield may produces spurious cues which affect the capability of a listener to localize the sound source. In the second embodiment, therefore, we make use of the concept of separating signals received by the microphones into their direct and diffuse components and reproducing them using different speaker elements. In particular, the direct soundfield will be reproduced using speakers pointing toward a listener, while the diffuse soundfield components will be additionally scattered. This can be achieved, for instance, by reproducing diffuse soundfield components using speakers pointing away from the listener and toward diffuser panels which perform additional sound scattering. Such a speaker set-up is shown in FIG. 10, where the speakers are arranged side by side. An alternative arrangement where the speakers are arranged back to back is shown in FIG. 11. Other speaker arrangements are also known which can have both components in one element and where both the direct and diffuse components are turned toward the listener, and which are also suitable. In this respect any speaker configuration which reproduces direct and diffuse soundfields separately and additionally preferably scatters the diffuse component may be used. In the second embodiment, therefore we process the input signals with partial input responses corresponding to the direct elements of the impulse response, or the diffuse elements of the impulse response only.

An example impulse response is shown in FIG. 3. Here it will be seen that the impulse response can be split up into a direct impulse response Hd(t) corresponding to that part of the impulse response located in window Wd, and a diffuse impulse response Hr(t) corresponding to that part of the impulse response located in window Wf. The split between the direct and the diffuse impulse responses can be made several ways, including taking the direct impulse response to be a given number of the first impulses of the whole impulse response, the initial part of the whole impulse response in a given time interval, or by extracting the direct and the diffuse impulse responses manually.

Within the second embodiment, similar processing is performed on the input signals $x_1(t)$, $x_2(t)$ and $x_3(t)$ as described previously in respect of the first embodiment, with the same object of making the input signals appear as if they are produced at locations i1, i2, and i3, in room 40 (see FIG. 4). However, within the second embodiment instead of using the entire impulse response to process each input signal, to produce an output signal, only a part of each of the impulse responses, being either the direct part or the diffuse part is used at each time. Such processing produces two output signals for each soundfield sampling location, being a direct output signal processed using the direct part of the impulse response, and a diffused output signal processed using the diffuse part of the impulse response. Thus, for a three channel input signal, six output channels are produced.

Figure 7:
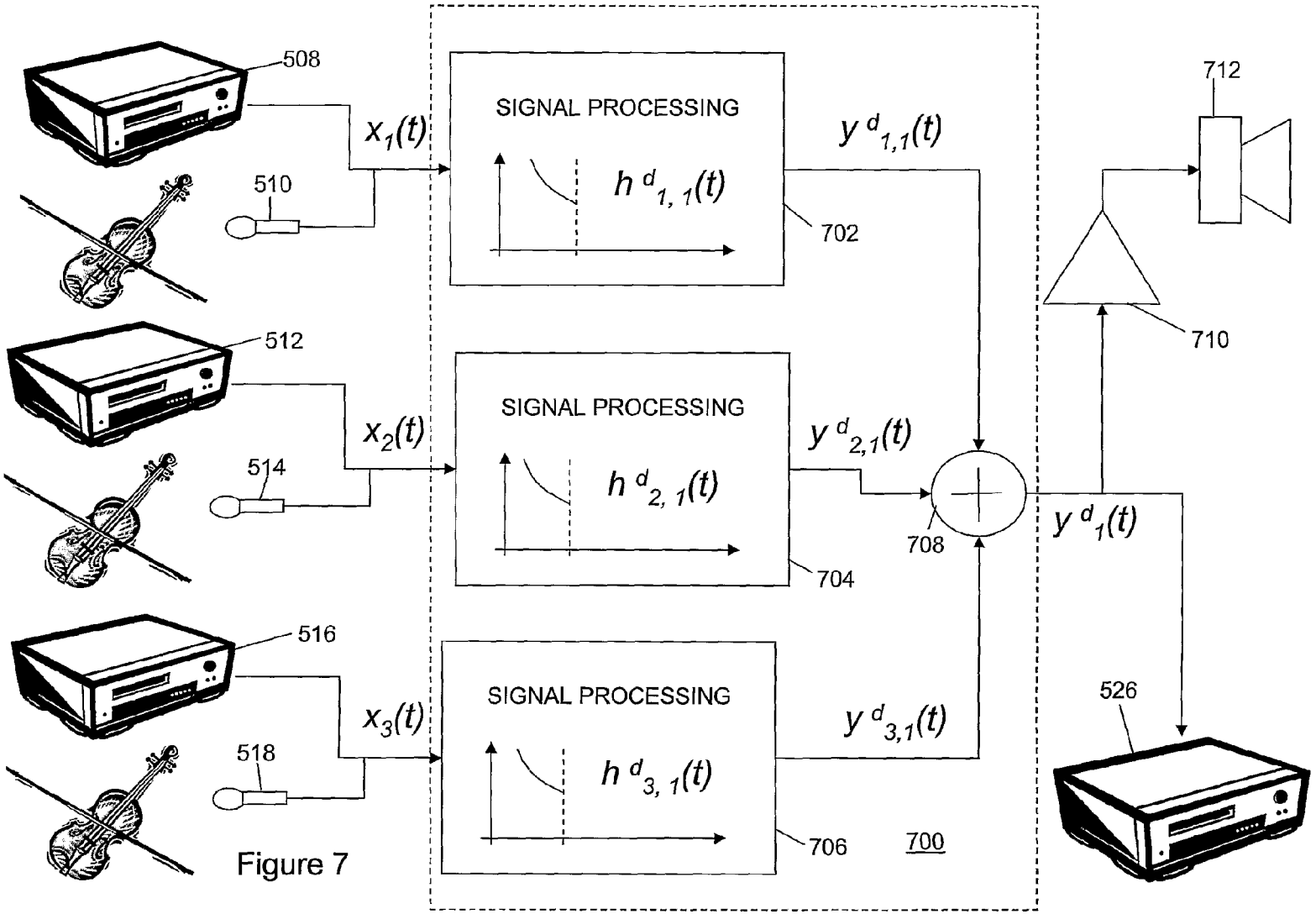
FIG. 7 is a block diagram of a part of a second embodiment of the present invention.
Figure 8:
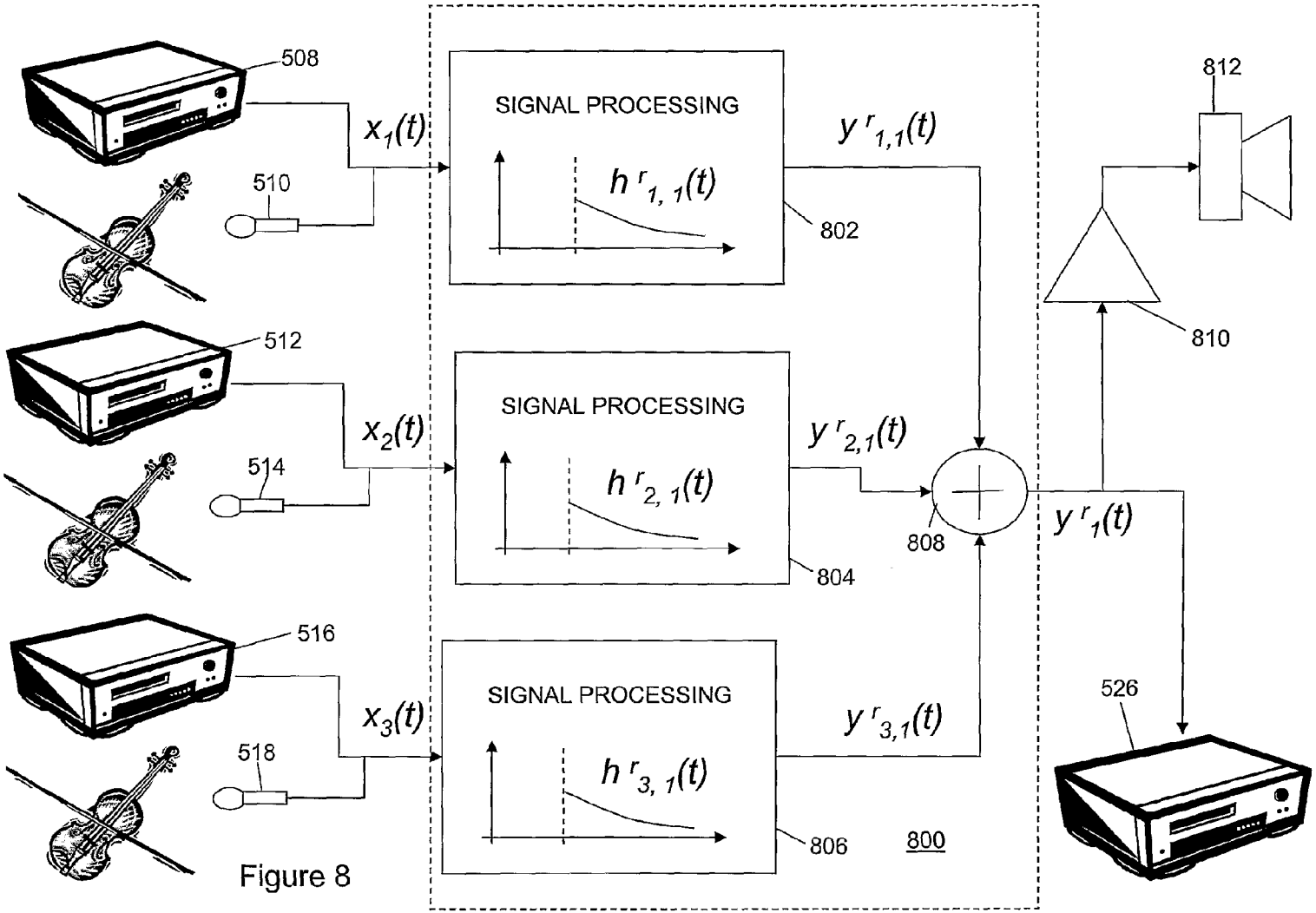
FIG. 8 is a block diagram of a part of a second embodiment of the present invention.
Figure 9:
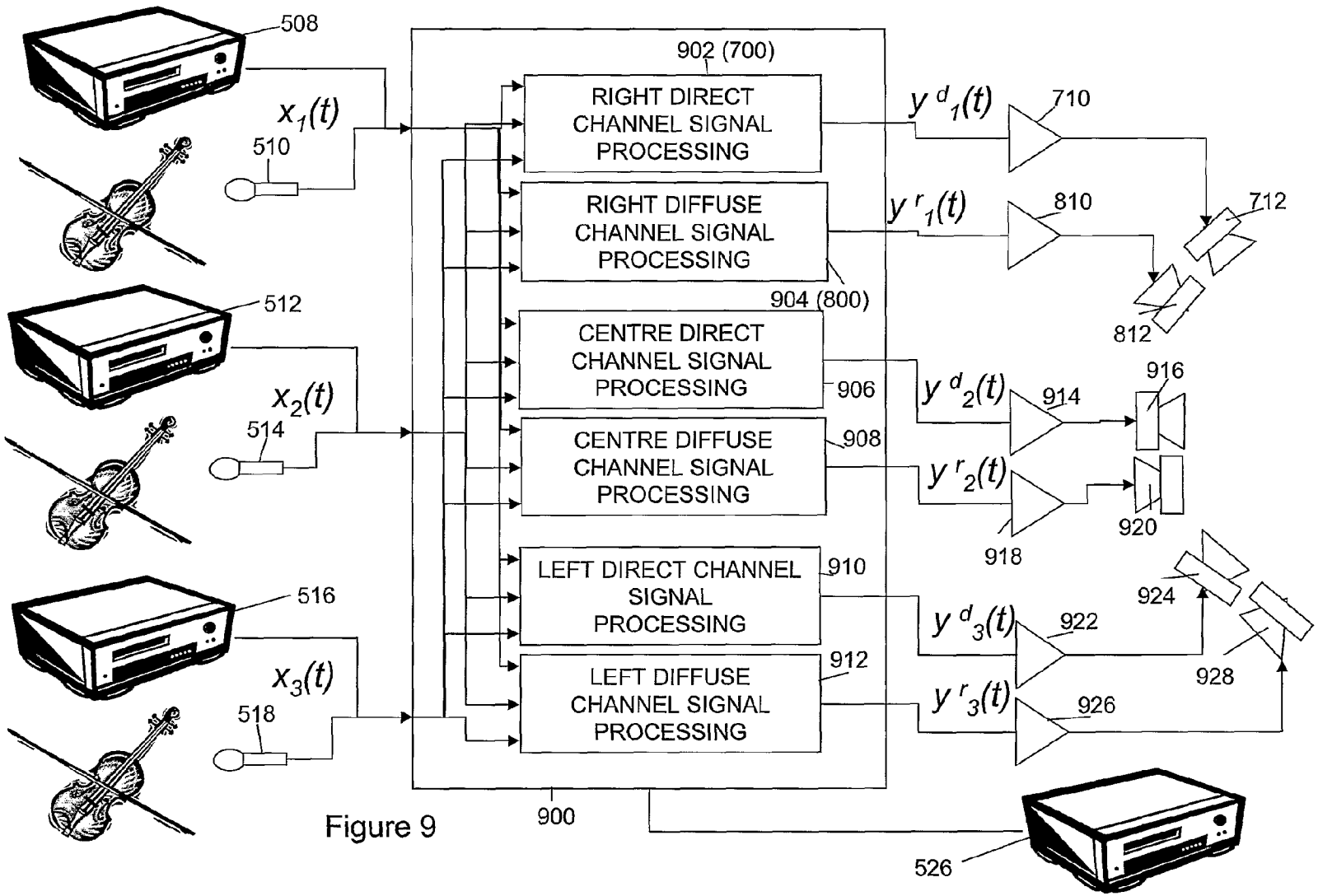
FIG. 9 is a block diagram of a second embodiment of the present invention.

Referring to FIGS. 7, 8, and 9, a system and method of the second embodiment will be described. FIG. 9 illustrates the whole system of the second embodiment. Here, a signal processor 900 receives input signals $x_1(t)$, $x_2(t)$, and $x_3(t)$, which are the same as used as inputs in the first embodiment previously described. The signal processor 900 contains in this case twice as many signal processing functions as the first embodiment, being two for each soundfield sampling location, so as to produce direct and diffuse signals corresponding to each soundfield sampling location. Therefore, a right channel direct signal processing means 902 is provided, as is a right channel diffuse signal processing means 904. Similarly, a centre channel direct signal processing means, and a centre channel diffuse signal processing means 906 and 908 are also provided. Finally, left channel direct and diffuse signal processing means 910 and 912 are also provided. Respective output signals are provided from each of these signal processing elements, each of which may be recorded by a recording device 526, or reproduced by respective channel amplifiers and appropriately located transducers such as speakers 712, 812, 916, 920, 924, or 928. As shown in FIG. 10 or 11, the speakers reproducing the diffuse output signals are preferably directed towards a diffuser element so as to achieve the appropriate diffusing effect.

FIG. 7 illustrates a processing block 700, which corresponds to the right channel direct signal processing means 902 of FIG. 9. Here, as in FIG. 8, it will be seen that signal processing block 700 contains as many internal signal processing elements 702, 704, and 706 as there are input signals, and that each internal signal processing element stores in this case part of an impulse response. Because in FIG. 7 signal processing block 700 corresponds to the right channel direct signal processing means, then the partial impulse responses stored in the internal signal processing elements 702, 704 and 706 are the direct parts of the impulse responses i.e. those contained within window Wd in FIG. 3. Each internal signal processing element 702, 704 and 706 convolves the respective input signal received thereat with the impulse response stored therein, again using equation 1 above, to produce a respective direct output signal which is then input to summer 708. The summer 708 then sums all of the respective signals received from the three internal signal processing elements 702, 704, and 706, to produce a right channel direct output signal Yd1(*t*). This signal can then be recorded by the recording means 526, or reproduced via the channel amplifier 710, and the speaker 712.

FIG. 8 illustrates the corresponding signal processing block 800, to produce the right channel diffuse output signal. In this respect, signal processing block 800 corresponds to the right channel diffuse signal processing means 904 of FIG. 9. Signal processing block 800 contains therein as many separate signal processing elements 802, 804, and 806 as there are input signals, each receiving a respective input signal, and each storing a part of the appropriate impulse response for the received input signal. Therefore, the first input signal x1(*t*) which is intended to be located at location i1 in room 40 is processed with the diffused part hr1,1(*t*) of impulse response h1,1(*t*) between source location i1, and sampling location j1. The processing applied to the input signals in each of the internal signal processing means is the same as described previously, i.e. applying equation 1 above, but with only the diffuse part of the impulse response. The three respective output signals are then combined in the summer 808, in this case to produce the right channel diffuse output signal Yr1(*t*). This signal can then be reproduced via channel amplifier 810 and speaker 812, and/or recorded via recording means 526.

Returning to FIG. 9, respective signal processing blocks 906, 908, 910, and 912, which correspond to signal processing block 700 or 800 as appropriate, are provided for each of the centre and left channels, to provide direct centre channel and diffuse centre channel output signals, and direct left channel and diffuse left channel output signals. The respective signal processing blocks 906, 908, 910, and 912 differ only insofar as the particular impulse responses which are stored therein, in the same manner as described previously with respect to FIGS. 7 and 8, but allowing for the fact that within the second embodiment direct and diffuse parts of the impulse responses are used appropriately.

The effects of the second embodiment are the same as previously described as for the first embodiment, and all the same advantages of being able to emulate instruments at different locations within different concert halls are obtained. However, in addition to these effects, within the second embodiment the performance of the system is enhanced by virtue of providing the separate direct and diffuse output channels. By using direct and diffuse output channels as described, the perception of the reproduced sound can be enhanced.

Third Embodiment

Extracting Source Signal from Multichannel Input

In the third embodiment, we describe a technique for extracting an original source signal from a multi channel signal, captured using a microphone array such as, for example, the Johnston array. The original source signal can then be processed into separate direct and diffuse components for reproduction, as described in the second embodiment.

Recording a musical performance using an N-channel microphone array, under the assumption of a single point source, produces N signals $$Y_i(z)=H_i(z)X(z),\ i=1\ldots,N \qquad \text{Eq. 3}$$

where X(z) is the source signal and Hi(z) is the impulse response of the auditorium between the source and the i-th microphone. Each impulse response Hi(z) can be represented as $$H_i(z)=H_{i,d}(z)+H_{i,r}(z) \qquad \text{Eq. 4}$$

where Hi,d(z) and Hi,r(z) are its direct and reverberant component, respectively. The goal is to find a method to recover direct and diffuse components Yi,d(z)=Hi,d(z)X(z) and Yi,r(z)=Hi,r(z)X(z) respectively, of all microphone signals Yi(z), given these signals and impulse responses Hi(z). To this end, we shall first recover X(z) from signals Yi(z) and then apply filters Hi,d(z) and Hi,r(z) to obtain Yi,d(z) and Yi,r(z) respectively. Components Hi,d(z) and Hi,r(z) can be obtained from Hi(z) in several ways, including taking Hi,d(z) to be a given number of the first impulses of Hi(z), the initial part of Hi(z) in a given time interval, or extracting Hi,d(z) from Hi(z) manually. Once, Hi,d(z) is obtained, Hi,r(z) is the remaining component of Hi(z).

In view of the above, the first task is to obtain X(z) given the plurality of input signal Yi(z). In the third embodiment, this is achieved using a system of filters, as described next.

The problem at hand was studied in-depth in the filter bank literature. Below we review relevant results, details of which can be found in Cvetkovic et al, "Oversampled Filter Banks", IEEE Trans Signal Processing, Vol 46, No. 5, pp 1245-1257, May 1998. X(z) can be reconstructed from Yi(z)'s in a numerically stable manner if and only if impulse responses Hi(z) do not have zeros in common on the unit circle. If this condition is satisfied then there exist stable filters Gi(z), i=1, . . . , N such that $$\sum_{i=1}^{N} G_i(z)H_i(z) = 1 \qquad \text{Eq. 5}$$

Hence, X(z) can be reconstructed as:—

$$X(z) = \sum_{i=1}^{N} G_i(z)Y_i(z) \qquad \text{Eq. 6}$$

Note that filters Gi(z) are not unique, and one particular solution is given by:—

$$G_i(z) = \frac{H_i(z^{-1})}{\sum_{i=1}^{N} H_i(z)H_i(z^{-1})} \qquad \text{Eq. 7}$$

This solution has an advantage over all other solutions in the sense that it performs maximal reduction of white additive noise which may be present in signals Yi(z). Another issue of particular interest is to be able to reconstruct X(z) using FIR filters. A set of FIR filters Fi(z) such that any X(z) can be reconstructed from corresponding signals Yi(z) exists if and only if impulse responses Hi(z) have no zeros in common. If this is satisfied, a set of FIR filters Fi(z) which can be used for reconstructing X(z) can be found by solving the system:

$$\sum_{i=1}^{N} F_i(z)H_i(z) = 1 \qquad \text{Eq. 8}$$

The problem of solving (8) for a set of FIR filters was previously studied by the communications community as a multichannel equalization problem, as described in Treichler et al. "Fractionally Spaced Equalisers", IEEE Signal Processing Magazine, Vol. 13 pp. 65-81. May 1996. Note that both the condition for perfect reconstruction of X(z) using stable filters and the condition for perfect reconstruction using FIR filters are normally satisfied since it is very unlikely that impulse responses Hi(z) will have a common zero.

From the above it will be seen that there are two approaches to obtaining X(z). The first is to us FIR filters obtained by solving Eq. 8, and we refer to this approach below as Method 1. The second is to use FIR approximations of filters in Eq. 7, and we refer to this approach below as Method 2.

Method 1

Finding a set of FIR filters Fi(z) which satisfy (8) amounts to solving a system of linear equations for the coefficients of the unknown filters. While solving a system of linear equations may seem trivial, in the particular case which we consider here a real challenge arises from the fact that the systems in question are usually huge, since impulse responses of music auditoria are normally thousands of samples long. To illustrate an expected dimension of the linear system, consider impulse responses Hi(z) and let Lh be the length of the longest one among them. Assume that we want to find filters Fi(z) of length Lf Then, the dimension of the linear system of equations which is equivalent to (8) is Lh+Lf−1. The system has an exact solution if the total number of variables, which is in this case NLf (the number of filters Fi(z) times the filter length), is larger or equal to the number of equations, that is, if NLf=>Lh+Lf−1. This implies that Lf must be greater than Lh/(N−1). Hence, the dimension of the system is greater than NLh/(N−1). In the case of 44.1 kHz sampling rate (CD quality), and assuming 5-channel microphone array (just the microphones in the horizontal plane), for a room which has a one second reverberation time, Lh=−44100 and the corresponding linear system has around 55000 equations. Given that it may be difficult to solve linear systems of such size, this first method is of more use for auditoria with relatively short impulse responses, giving a smaller linear system to solve. Linear systems of up to 17,000 equations were proved solvable using MATLAB.

Another problem associated with this approach is that the effect of filters Fi(z) obtained in this manner on possible additive noise is unclear. To ensure good noise reduction properties one needs to allow for filters longer than the minimal length required to solve the system exactly and then perform constrained optimization of an intricate function of a huge number of variables.

Method 2

Equation (7) provides a closed form solution for filters Gi(z) which can be used for perfect reconstruction of X(z) according to (6). Observe that filters Gi(z) given by this formula are IIR filters. One way to use these filters would be to implement them directly as IIR filters, but that would require an unacceptably high number of coefficients. Another way would be to find FIR approximations. The FIR approximations to can be obtained by dividing the DFT of corresponding functions $Hi(z^{-1})$ by the DFT of D(z) and finding the inverse DFT of the result. Here, D(z) is given by:—

$$\sum_{i=1}^{N} H_i(z)H_i(z^{-1}) \qquad \text{Eq 9}$$

The size of the DFT used for this purpose was four times larger than the length of D(z). Note that it is important that the DFT size is large since Method 2 computes coefficients of IIR filters Gi(z) by finding their inverse Fourier transform using finitely many transform samples. This discretization of the Fourier transform causes time aliasing of impulse responses of filters Gi(z) and the aliasing is reduced as the size of the DFT is increased. Despite the need for the DFT of large size, Method 2 turned out to be numerically much more efficient than Method 1 and could operate on larger impulse responses.

Reconstruction of X(z) using this approximation also gave very accurate results.

Figure 12:
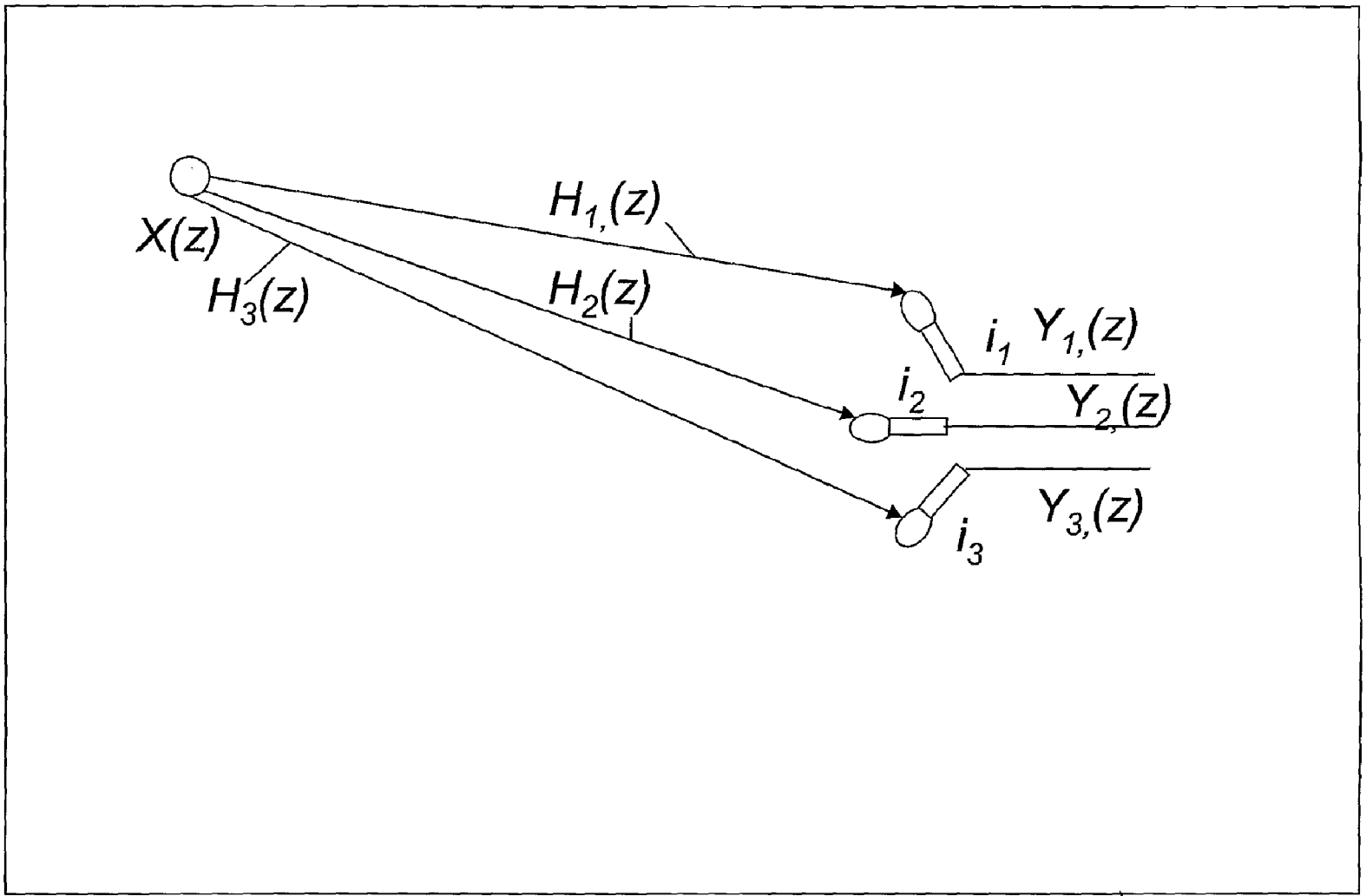
FIG. 12 is a diagram illustrating impulse responses between a single sound source and three soundfield sampling locations in a performance venue.

In view of the above, consider the arrangement shown in FIG. 12. Here, a room 120 comprises a recording array which samples the soundfield at locations i1, i2, and i3. A single source signal X(z) is present at a particular location in the room, and the respective impulse responses are h1(*z*) between the source and location i1, h2(*z*) between the source and location i2, and h3(*z*) between the source and location i3. Respective soundfield sample signals y1(*z*), y2(*z*), and y3(*z*) are obtained from the three soundfield sampling locations.

Figure 13:
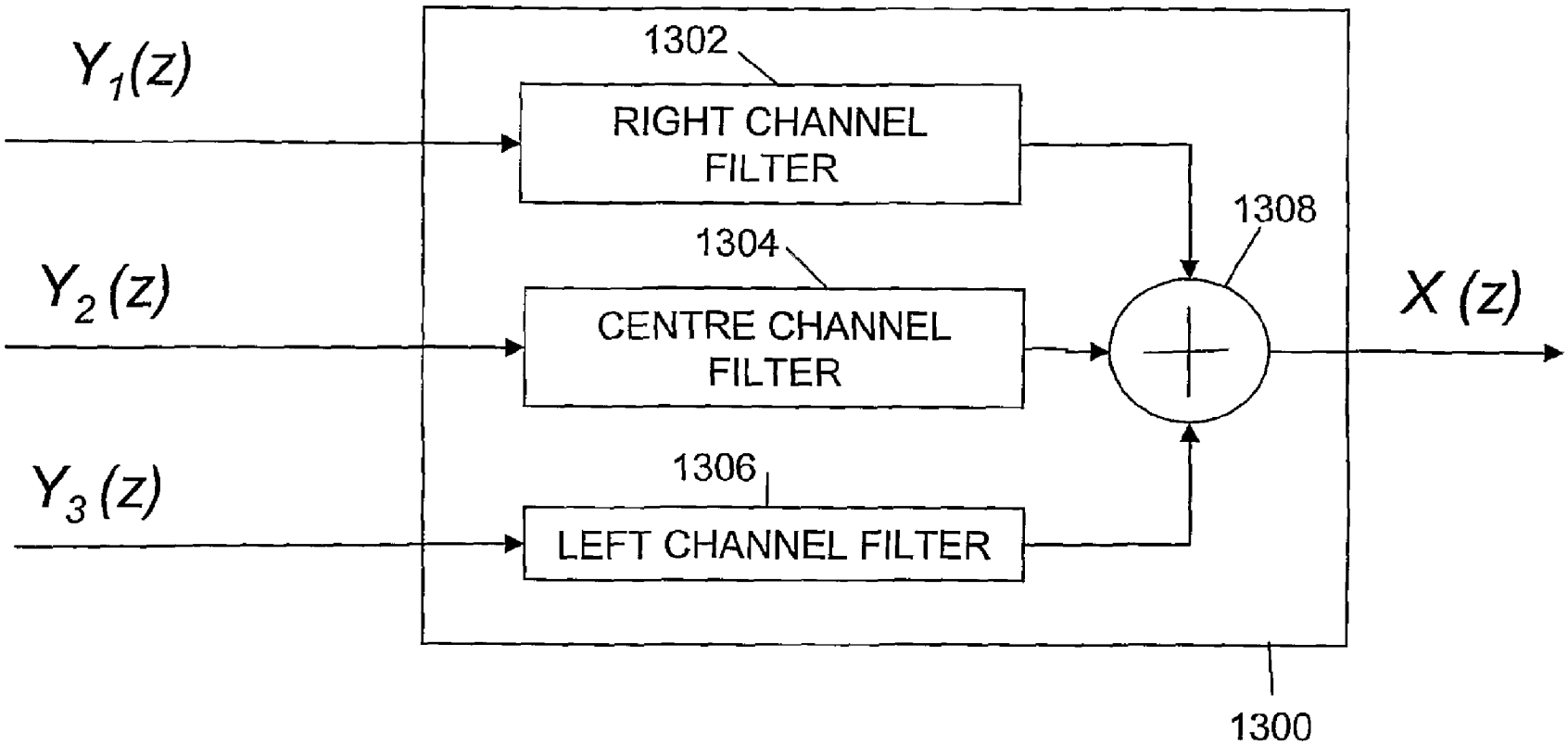
FIG. 13 is a block diagram of a part of the third embodiment of the present invention.

In order to obtain the source signal x(z) from the output signals y1(*z*) it is necessary to process the signals y1(*z*) in accordance with equation 6 above, as shown in FIG. 13. Here, a signal processing filter 1300 comprises a right channel filter 1302, a centre channel filter 1304, and a left channel filter 1306. The filters 1302, 1304, and 1306 have filter co-efficience determined by either of method 1, or method 2 above, given the respective impulse responses h1(*z*) for the right channel filter, h2(*z*) for the centre channel filter, and h3(*z*) for the left channel filter. Hence, the respective filters are able to compensate for the impulse responses, to allow the source signal to be retrieved.

Therefore, as shown in FIG. 13, the right channel filter 1302 filters the signal y1(*z*) obtained from sound field sampling location i1, whereas the centre channel filter 1304 filters the signal y2(*z*) obtained from the soundfield sampling location i2. The left channel filter 1306 filters the signal y3(*z*), obtained from the soundfield sampling location i3. The resulting filtered signals are input into a summer 1308, wherein the signals are summed to obtain original source signal x(z), in accordance with equation 6 above. Therefore, using the filter processor 1300 of the third embodiment, where a source has been recorded by a microphone array within a particular performance venue, and by applying appropriate filters to the multiple channel signals the original source signal can be recreated.

Figure 14:
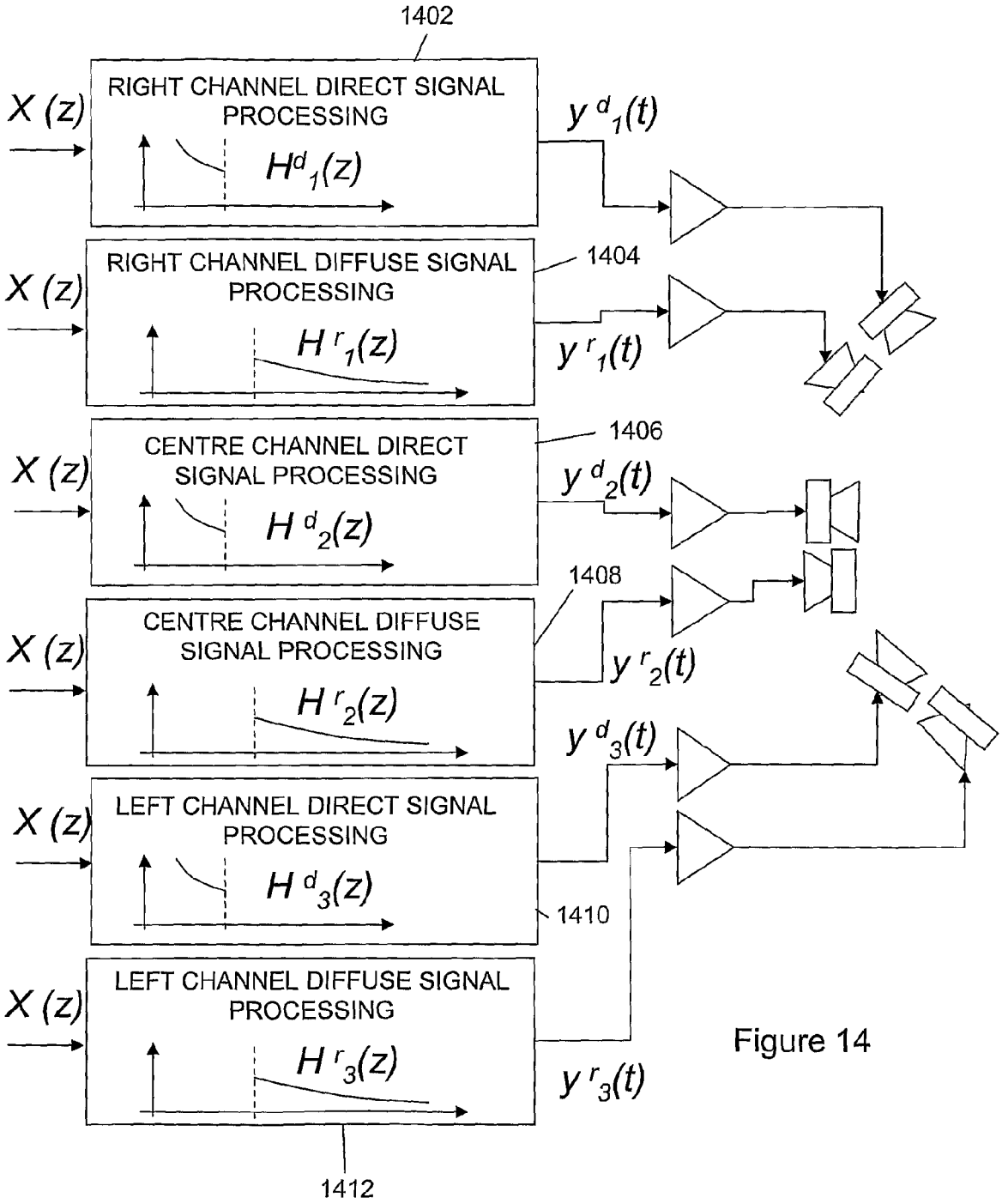
FIG. 14 is a block diagram of a part of the third embodiment of the present invention.

Within the third embodiment the purpose of recreating the original source signal is to then allow the source signal to be processed with direct and diffuse versions of the impulse responses, to produce direct and diffuse versions of the right channel, centre, and left hand signals. In other embodiments, however, the retrieved source signal may be put to other uses, however, and in this respect the elements described above which retrieve the source signal from the multi-channel signal can be considered as an embodiment in their own right. However in the third embodiment being particularly described such processing to split the retrieved source signal into direct and diffuse elements was described earlier in respect of the second embodiment, but is shown in respect of the third embodiment in FIG. 14. Here, signal processing elements 1402, 1404, 1406, 1408, 1410, 1412, and 1414 each receive the source signal x(z) and process it so as to convolve the source signal with an appropriate impulse response, being either the direct part of the appropriate impulse response, or the diffuse part of the impulse response. Thus, for example, the right channel direct signal processing element 1402 convolves the input signal with the direct part hd1(*z*) of the impulse response h1(*z*), to produce an output signal yd1(*t*) when converted back into the time domain. Similarly, the right channel diffuse signal processing element 1404 processes the source signal x(z) with the diffuse part of impulse response h1(*z*), being hr1(*z*), to give diffuse right channel output signal yr1(*t*), in the time domain. Similar processing is performed by the other processing elements, as shown in FIG. 14. The output signals thus obtained can then be reproduced by respective channel amplifiers and speakers, or recorded by suitable recording means. It will be noted that this processing as shown in FIG. 14 and described above is the same as that described previously in respect of the second embodiment, but applied to a single source signal, being the recovered source signal x(z). As shown in FIG. 14, when the output signals are reproduced, they are preferably done so by speakers which are spatially arranged in an analogous manner to the soundfield sampling locations, again as described previously in respect of the second embodiment.

Fourth Embodiment

Extracting Multiple "Dry" Signals from Multiple Input Signals

A fourth embodiment of the invention will now be described, which allows for the extraction of "dry" signals from multiple sources, from a multi channel recording made in a venue using a soundfield capture array of the type discussed previously. The fourth embodiment therefore extends the single sound source extraction technique described in the third embodiment to being able to be applied to extract multiple sound sources.

Consider first an arrangement as shown in FIG. 4, discussed previously. Here, multiple sound sources i1, . . . , i3 are present in a room 40, and the sound produced thereby is captured by a soundfield capture array comprising multiple microphones j1, . . . , j3. The impulse responses hi,j(t) (Hij(z) in the Z-domain) between each sound source location i and each microphone location j is known, for example having been measured, as discussed above in respect of the other embodiments. A sound signal x1(*t*) located at sound source i1 is received at microphones, for example, having been subject to impulse response h1,1(*t*), as discussed previously with respect to the first embodiments. Similarly, as also discussed previously, the actual signal y1(*t*) output by microphone j1 is a summation of the each of the signals produced by the respective sound sources convolved with the respective impulse responses between their locations and the location of microphone j1 (see Eq. 2, previously).

Within the fourth embodiment, the problem solved thereby is to produce a filter function G(z) which will accept the multiple inputs captured by the microphones which signals themselves represent multiple sound sources, and allow the isolation and dereverberation (i.e. removal of the effects of the impulse response of the venue) of the received sound signals so as to obtain "dry" signals corresponding to each individual sound source.

Figure 15:
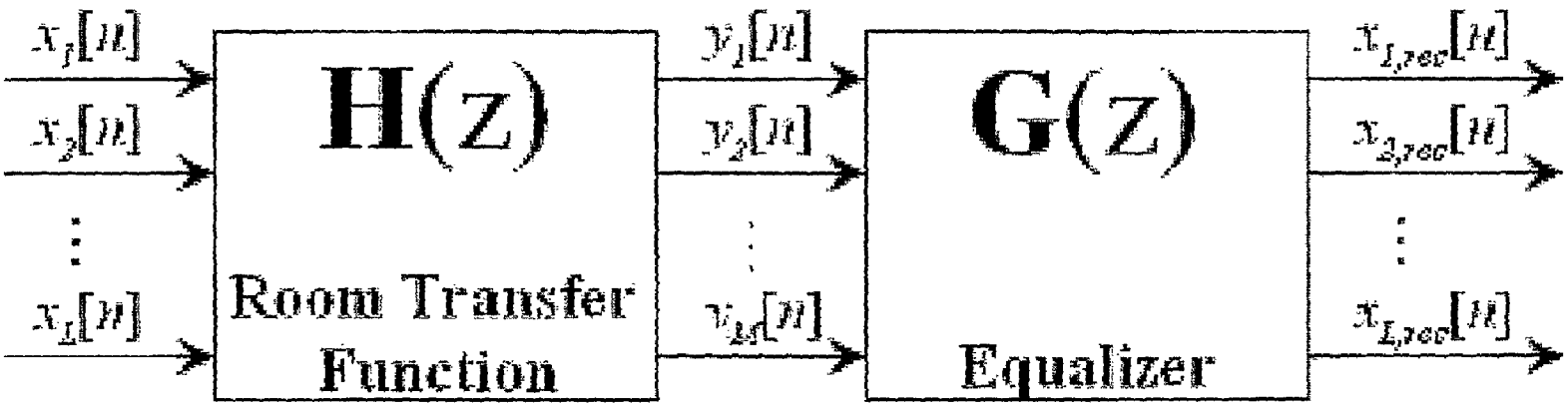
FIG. 15 is a diagram of a system representation used in the fourth embodiment of the present invention.

To solve this problem consider the system in the manner shown in FIG. 15. Here L instruments are playing in an acoustic space and M microphones record the soundfield. The signal captured by mth microphone is given by:—

$$Y_m(z) = \sum_{l=1}^{L} H_{lm}(z) X_l(z) \qquad \text{Eq. 10}$$

where Xl(z) is the signal of the lth instrument and Hlm(z) is the transfer function of the space between lth instrument and mth microphone. The problem addressed herein is to reconstruct (dereverberate) signals X1(*z*), . . . , XL(z) from their convolutive mixtures Y1(*z*), . . . , YM(z). In matrix notation, the microphone signals are given by:

$$Y(z) = H(z)X(z) \quad \text{Eq. 11}$$

where $$Y(z) = [Y_1(z), \ldots, Y_M(z)]^T,$$

$$X(z) = [X_1(z), \ldots, X_L(z)]^T,$$

and $$H(z) = \begin{bmatrix} H_{11}(z) & \ldots & H_{L1}(z) \\ \vdots & \ddots & \vdots \\ H_{1M}(z) & \ldots & H_{LM}(z) \end{bmatrix}.$$

The dereverberation requires finding a matrix of equalization filters, $$G(z) = \begin{bmatrix} G_{11}(z) & \ldots & G_{1M}(z) \\ \vdots & \ddots & \vdots \\ G_{L1}(z) & \ldots & G_{LM}(z) \end{bmatrix},$$

such that M(z)=G(z)H(z), the transfer function of the cascade of the acoustic space and the equalizer G(z), is a pure delay, $$M(z)=G(z)H(z)\equiv z^{-\Delta}I_{L\infty L}(z). \quad \text{Eq. 12}$$

A necessary and sufficient condition for the existence of such a matrix of stable filters is that H(z) is of full-rank everywhere on the unit circle. The minimum norm solution for G(z) is then provided by the left pseudo-inverse of H(z), $$G(Z)=(H^T(z^{-1})H(z))^{-1}H^T(z^{-1}) \quad \text{Eq. 13}$$

Exact computation of the pseudoinverse of H(z) is numerically prohibitive, since its entries are polynomials of very high orders, e.g. around 44,000 for 1s reverberation time at 44.1 kHz sampling. Furthermore, G(z) will be non-causal and will result in IIR filters if $|H^T(z^{-1})H(z)|$ is not a pure delay. Below, we propose a numerically efficient algorithm to find an FIR approximation of the left pseudoinverse of H(z).

Let Eq. 14

$$B(z) = \begin{bmatrix} B_{11}(z) & \ldots & B_{1L}(z) \\ \vdots & \ddots & \vdots \\ B_{L1}(z) & \ldots & B_{LL}(z) \end{bmatrix} = H^T(z^{-1})H(z).$$

Then $$G(z) = B^{-1}(z)H^T(z^{-1}) \quad \text{Eq. 15}$$

and $$B^{-1}(z) = \frac{\begin{bmatrix} CofB_{11}(z) & \ldots & CofB_{1L}(z) \\ \vdots & \ddots & \vdots \\ CofB_{L1}(z) & \ldots & CofB_{LL}(z) \end{bmatrix}}{D(z)} \quad \text{Eq. 16}$$

where $$D(z) = |B(z)| = \text{Determinant of } B(z)$$

and $$CofB_{ij}(z) = (-1)^{i+j}|B_{kn}(z)|, k \neq i, n \neq j$$

Since CofBij(z) and D(z) are polynomials in z, it should be noted that if we try to invert the matrix B(z) directly, the inverse matrix $B^{-1}(z)$ will result in IIR filters. This, of course, is not an ideal solution. However, we can use this direct matrix inversion approach to approximate the inverse IIR filters with FIR filters. The FIR approximation to $B^{-1}(z)$ are obtained by dividing the N-point DFT of the corresponding cofactors, CofBij(z), i=1, . . . , L, j=1, . . . , L, by the N-point DFT of D(z).

$$B^{-1}(e^{j\frac{2\pi}{N}k}) = \frac{\begin{bmatrix} CofB_{11}(e^{j\frac{2\pi}{N}k}) & \ldots & CofB_{1L}(e^{j\frac{2\pi}{N}k}) \\ \vdots & \ddots & \vdots \\ CofB_{L1}(e^{j\frac{2\pi}{N}k}) & \ldots & CofB_{LL}(e^{j\frac{2\pi}{N}k}) \end{bmatrix}^T}{D(e^{j\frac{2\pi}{N}k})} \quad \text{Eq. 17}$$

k=0, 1, . . . , N−1. Then, the N-point inverse discrete Fourier transform of (8) results in an FIR approximation of the matrix $B^{-1}(z)$. Finally, the equalizer G(z) can be obtained from (15). It should be noted that the size of the FFT (N) must be greater than or equal to the length of D(z). The minimum size of the FFT, therefore, is given by:

$$FFTSize_{Min}=L_d=2L(L_h-1)+1 \quad \text{Eq. 18}$$

where Lh is the length of room impulse response and Ld is the length of D(z). Accordingly, the minimum length that the inverse filters can have is given by $$L_{g,Min}=L_d+L_h-1=2L(L_h-1)+L_h. \quad \text{Eq. 19}$$

This algorithm computes the coefficients of IIR filters Glm (z) by finding the inverse Fourier transform using finitely many transform samples. This discretization of the Fourier transform causes time aliasing of $B^{-1}(z)$ which is reduced as the size of FFT is increased.

Figure 16:
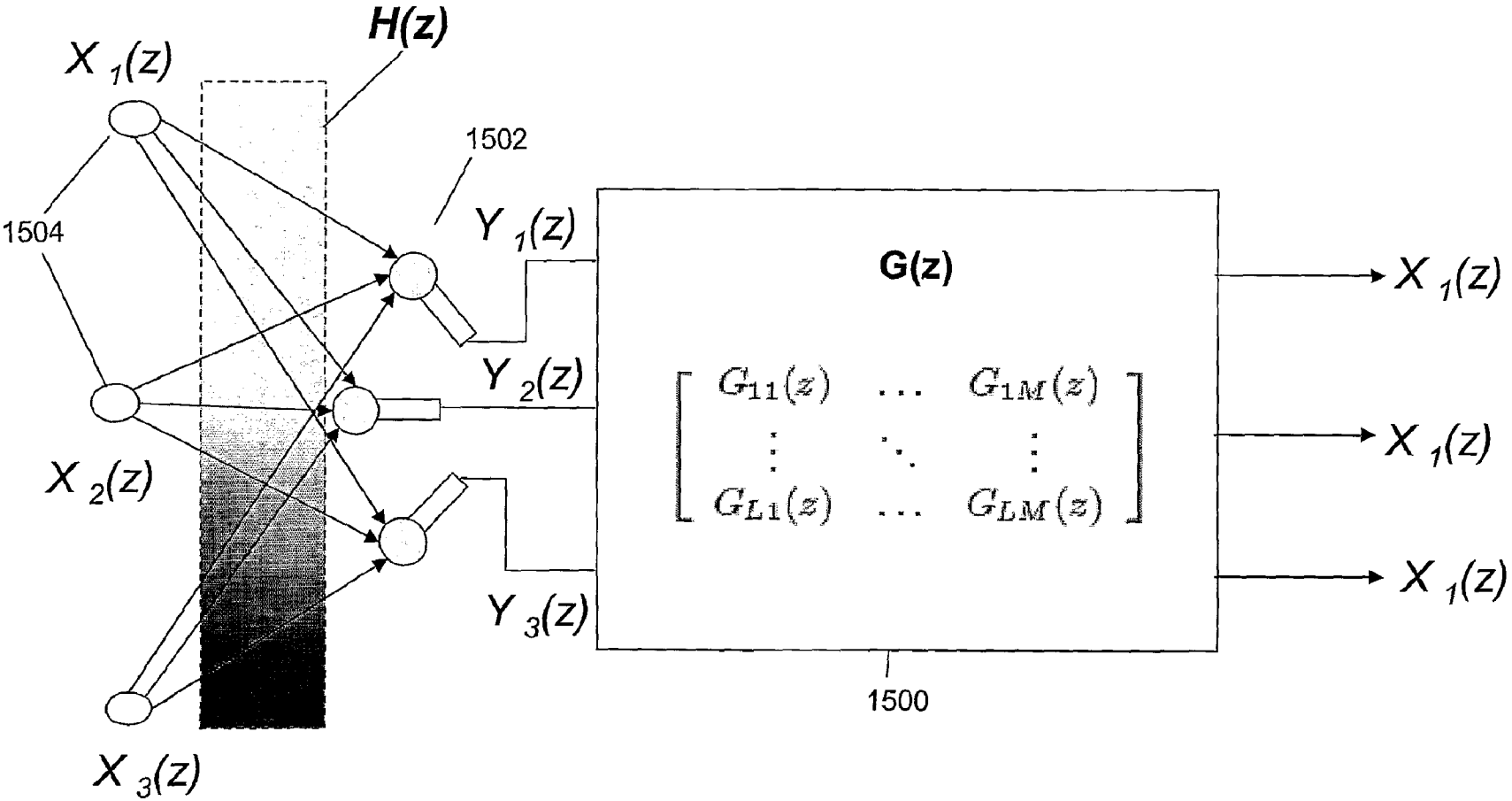
FIG. 16 is a block diagram of a system according to the fourth embodiment of the invention.

In view of the above, the fourth embodiment of the invention applies the above algorithm to find the filter transfer function G(z) which can then be used in signal processor to obtain the "dry" de-reverbed signals from the recorded soundfield. FIG. 16 illustrates an example system which provides the "dry" signals using a signal processing unit provided with filter transfer function G(z). More particularly, a signal processing unit 1500, which may for example be a computer provided with appropriate software, or a DSP chip with appropriate programming software, is provided in which is stored the filter transfer function G(z), determined for a particular venue as described previously. As discussed, to avoid using IIR filters an FIR approximation is preferably obtained, by dividing the N-point DFT of the IIR cofactors of B(z) by the N-point DFT of the determinant D(z) of B(z).

The signal processing unit 1500 receives multiple input signals Y1(z), . . . , YM(z) recorded by the microphone array 1502, which signals correspond to original source signals X1(z), . . . , Xl(z), as discussed previously, subject to the room transfer function H(z). The microphone array 1502 is arranged as discussed in the previous embodiments, and may be subject to any of the alterations in its arrangements discussed previously. The signal processing unit 1500 then applies the received multiple signals from the microphone array to the equalizer represented by G(z), to obtain the original source signals X1(z), . . . , Xl(z. The recovered original source signals may then be individually recorded, or may be used as input into a recording or reproducing system such as that described previously in the second embodiment to allow the direct and diffuse components to be reproduced separately.

Additionally, or alternatively, the recovered original source signals may be used as input signals into a recording or reproducing system of the first embodiment, but which then makes use of different transfer functions obtained from a different venue to emulate the sound being in the latter venue. With such an arrangement it is possible to take a multiple sound source recording from one venue, obtain the "dry"

original signals representing each sound source individually, and then process the "dry" signals according to a different venue's transfer function to make it appear that the recording was made in the different venue. Of course, such different venue transfer functions may also be used when the recovered signals are used as input to a system according to the second embodiment.

Figure 17:
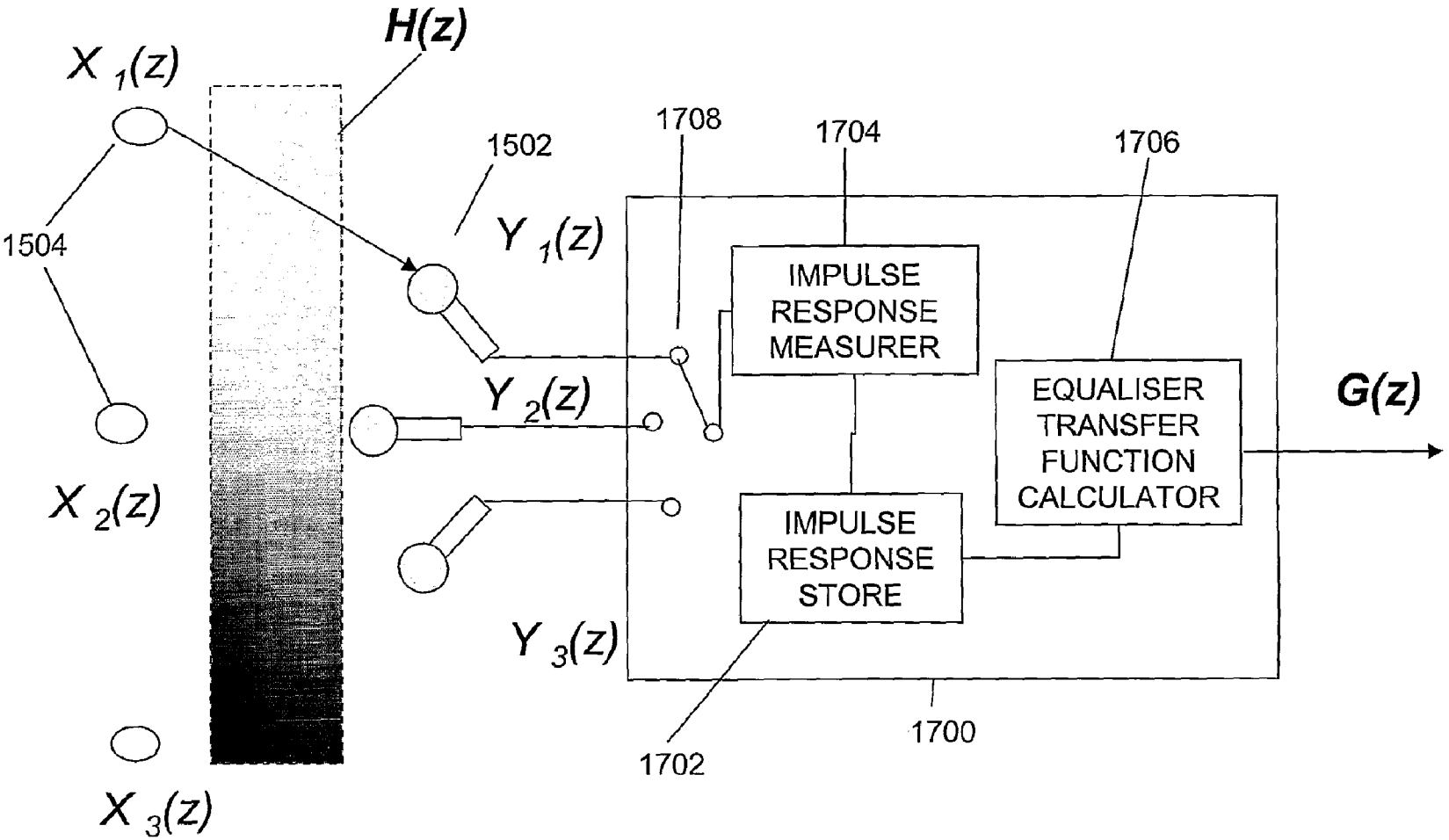
FIG. 17 is a block diagram of a system used with the fourth embodiment of the invention, and forming another embodiment.

In order to obtain the equaliser transfer function G(z), a system such as shown in FIG. 17 is provided. Here, an equaliser transfer function calculation unit 1700 comprises a switch 1708 arranged to connect to each of the microphones in the microphone array 1502 in turn. The switch connects each microphone to an impulse response measurement unit 1704, which measures an impulse response between each sound source location and each microphone in turn, and stores the measured impulse responses in an impulse response store 1702, being a memory or the like. The impulse responses are obtained by setting the switch 1708 to each microphone in turn, and measuring the impulse response to each sound source location for each microphone. Other techniques of, for example, calculating the impulse response may also be used, in other embodiments.

Howsoever the impulse responses are obtained, the equaliser transfer function calculator unit 1706 is able to read the impulse responses from the impulse response store, and calculate the equaliser transfer function G(z), using the technique described above with respect to Equations 10 to 19, and in particular obtains the FIR approximation as described previously. It should be noted, however, that the equalizer has its limitations. If the condition L<M is not satisfied, D(z) is very close to zero because the matrix H(z) is not well-conditioned at all frequencies. Hence, accurate inversion of the system is not achieved regardless of the FFT size. Therefore, a restriction of this algorithm is that the number of sound sources is less than the number of microphones capturing the auditory scene.

Having previously described the mathematical design, this section presents the evaluation of the equalization algorithm described in Section 2. For comparison, a semi-blind adaptive multichannel equalization algorithm presented in Weiss S. et al. "Multichannel Equalization in Subbands", Proceedings of the IEEE Workshop on Applications of Signal Processing to Audio and Acoustics, pp. 203-206, New Paltz, N.Y., October 1999, was also implemented. This method uses a multichannel normalized least mean square (M-NLMS) algorithm for the gradient estimation and the update of the adaptive inverse filters. A quantitative performance measure used to evaluate these algorithms is the Relative Error given by $$RelativeError = \frac{MSE}{Energy_{Average}} = \frac{\sum_n |x[n] - x_{rec}[n]|^2}{\sum_n |x[n]|^2}. \quad \text{Eq. 20}$$

Impulse responses, Hkm(z), were generated for hypothetical rectangular auditoria using the method of images known in the art. Since the adaptive equalizer requires very long time for training, we use relatively short impulse responses in the numerical experiments so as to compare both algorithms. However, the algorithm proposed in this paper can effectively equalize longer impulse responses as well. Here we present results to establish post-equalization of audio signals using both algorithms for the following two cases: L=2, M=5 and L=3, M=5. Dry test signals used were: jazz trumpet and saxophone in the L=2 case, and electric jazz guitar, jazz trumpet, and saxophone in the L=3 case. All test signals were 23 s high quality audio files, sampled at 44.1 kHz, and recorded with a close microphone technique to minimize early reflections and reverberation. The quantitative results and impulse responses of the equalized system for the two scenarios are presented in Tables 1-4, respectively in FIG. 18. In both cases the size of the FFT used in the proposed algorithm was set to be twice the minimum size given in Eq. 18. In the case of two sources, the adaptive algorithm was trained using a sequence of 400,000 samples, while in the case of three sources, the training sequence was 600,000 samples long. We can observe from Tables 1-4 that the proposed FFT-based algorithms attains a 40-50 dB higher accuracy than the adaptive algorithm in the case of two sound sources, and over 60 dB higher accuracy in the case of three sources. This improvement is paid by considerably longer filters of the FFT-based equalizer compared to the adaptive algorithm. The number of coefficients in the filters of the adaptive equalizer was set to be equal to length of the room impulse response, since we found that longer or shorter filters were yielding less accurate results. In terms of numerical complexity, the adaptive algorithm requires long training sequences for the adaptive filters to converge and is, therefore, computationally considerably less efficient than the method of the present embodiment.

Referring to FIG. 18, Table 1 illustrates quantitative results of multichannel equalization using the adaptive equalizer in the case of L=2 source signals and M=5 microphones. Each column corresponds to an individual source signal. Lg—the length of the equalizer filters is set to be equal to Lh—the length of the room impulse responses.

Table 2. shows quantitative results of multichannel equalization using the FFT-based equalizer in the case of L=2 source signals and M=5 microphones. Each column corresponds to an individual source signal. Lg—the length of the equalizer filters. Lh—the length of the room impulse responses.

Table 3 shows quantitative results of multichannel equalization using the adaptive equalizer in the case of L=3 source signals and M=5 microphones. Each column corresponds to an individual source signal. Lg—the length of the equalizer filters is set to be equal to Lh—the length of the room impulse responses.

Table 4 shows quantitative results of multichannel equalization using the FFT-based equalizer in the case of L=3 source signals and M=5 microphones. Each column corresponds to an individual source signal. Lg—the length of the equalizer filters, Lh—the length of the room impulse responses.

Finally we investigated the impact of the size of the FFT on the equalization accuracy. Tables 5-6 in FIG. 19 illustrate the effect of the FFT size on the relative error of dereverberation for the same mixtures of L=2 and L=3 signals, respectively, which were used for experiments shown in Tables 2 and Table 4. An increase in the size of the FFT reduces the time aliasing of the inverse filters, hence decreasing the relative error accordingly. Results shown in Tables 5-6 suggest that in this way the error could be made arbitrarily small. But increasing the size of the FFT in turn increases the length of the inverse filters. Therefore, the size of the FFT should be kept moderate enough such that the inverse filters are not very long and the relative error is small enough so that the difference between the original dry source signals and the reconstructed signals is below the level of human hearing.

Within the above described embodiments the signal processing operations performed are described functionally in terms of the actual processing which is performed on the signals, and the resulting signals which are generated. Concerning the hardware required to perform the processing operations, it will be understood by the person skilled in the art that hardware may take many forms, and may be, for example, a general purpose computer system running appropriate signal processing software, and provided with a multichannel sound card to provide for multichannel outputs. In other embodiments, programmable or dedicated digital signal processor integrated circuits may be used. Whatever hardware is used, it should preferably allow different impulse responses to be input and stored, it should preferably allow for the input of a suitable number of input signals as appropriate, and also preferably for the selection of input signals and assignment of such signals to locations corresponding to the impulse responses within an auditorium or venue to be emulated.

Within this description reference has been made to prior art documents where appropriate, any contents of which necessary for understanding the present invention are incorporated herein by reference.

Various modifications may be made to any of the above described embodiments to produce other embodiments in the invention, which will fall within the appended claims.

The invention claimed is:

1. An audio signal processing method comprising:

obtaining one or more impulse responses, each impulse response corresponding to the impulse response between a single sound source location and a single soundfield sampling location;

receiving an input audio signal; and processing the input audio signal with at least part of the one or more impulse responses to generate one or more output audio signals, the processing being such as to emulate within the output audio signal the input audio signal as if located at the sound source location;

wherein the processing comprises processing the input audio signal with respective parts of the impulse responses corresponding to direct components of the impulse responses to generate one or more direct audio output signals.

2. A method according to claim 1, wherein the processing further comprises:

processing the input audio signal with respective parts of the impulse responses corresponding to reverberant components of the impulse responses to generate one or more reverberant audio output signals.

3. A method according to claim 1, wherein the obtaining step further comprises obtaining impulse responses corresponding to the impulse responses between a plurality of sound source locations and a plurality of soundfield sampling locations to provide a plurality of sets of impulse responses, each set comprising the impulse responses between the plurality of sound source locations and one of the soundfield sampling locations;

the method further comprising receiving a plurality of audio input signals and assigning each of the audio input signals to a sound source location, the processing step further comprising, for each output audio signal corresponding to a particular one of the soundfield sampling locations: processing the input audio signals with at least part of the impulse responses of the set of impulse responses corresponding to the particular soundfield sampling location to generate the output audio signal, the processing being such as to emulate within the output audio signal the input audio signals as if located at their respective assigned sound source locations.

4. A method according to claim 1, wherein there are at least three soundfield sampling locations.

5. A method according to claim 1, wherein there are plural soundfield sampling locations and the soundfield sampling locations are equiangularly, equidistantly, or both equiangularly and equidistantly arranged about a point.

6. A method according claim 1, further comprising recording, reproducing, or both recording and reproducing the output audio signals.

7. A method according to claim 6, wherein the output audio signals are reproduced via respective transducers, and wherein the transducers are arranged in a corresponding relative spatial distribution to the relative spatial distribution of the soundfield sampling locations.

8. A method according to claim 1, wherein there are at least five soundfield sampling locations.

9. An audio signal processing method comprising:

obtaining one or more impulse responses, each impulse response corresponding to the impulse response between a single sound source location and a single soundfield sampling location;

receiving an input audio signal; and processing the input audio signal with at least part of the one or more impulse responses to generate one or more output audio signals, the processing being such as to emulate within the output audio signal the input audio signal as if located at the sound source location;

wherein the obtaining further comprises obtaining impulse responses corresponding to the impulse responses between a plurality of sound source locations and a plurality of soundfield sampling locations to provide a plurality of sets of impulse responses, each set comprising the impulse responses between the plurality of sound source locations and one of the soundfield sampling locations;

the method further comprising receiving a plurality of audio input signals and assigning each of the audio input signals to a sound source location, the processing step further comprising, for each output audio signal corresponding to a particular one of the soundfield sampling locations: processing the input audio signals with at least part of the impulse responses of the set of impulse responses corresponding to the particular soundfield sampling location to generate the output audio signal, the processing being such as to emulate within the output audio signal the input audio signals as if located at their respective assigned sound source locations;

wherein to generate one of the output signals corresponding to a particular soundfield sampling location each input signal is processed with the impulse response between the sound source location to which the input signal is assigned and the particular soundfield sampling location to give an intermediate output signal, the intermediate output signals then being combined into the output signal for the particular soundfield sampling location.

10. An audio signal processing method comprising:

obtaining a plurality of audio signals by sampling a soundfield at a plurality of soundfield sampling locations, the soundfield being caused by a sound source producing a source signal; and processing the plurality of audio signals to obtain the source signal;

wherein the processing comprises filtering the plurality of audio signals with respective filters, and wherein a filter transfer function of the filter used to filter the audio signal obtained at a particular one of the soundfield sampling locations is a function of the impulse response between the sound source and the particular soundfield sampling location.

11. A method according to claim 10, wherein the filters have transfer functions which at least approximate to:

$$G_i(z) = \frac{H_i(z^{-1})}{\sum_{i=1}^{N} H_i(z)H_i(z^{-1})}$$

where Gi(z) is the filter transfer function for the audio signal recorded at soundfield sampling location i, and Hi(z) is the impulse response between the sound source and soundfield sampling location i.

12. An audio signal processing method comprising:

obtaining a plurality of audio signals by sampling a soundfield at a plurality of soundfield sampling locations, the soundfield being caused by a sound source producing a source signal; and processing the plurality of audio signals to obtain the source signal;

wherein the soundfield is caused by a plurality of sound sources producing a respective plurality of source signals, and the processing comprises processing the plurality of audio signals to obtain the plurality of source signals; and wherein the processing comprises inputting the plurality of audio signals into a multiple input equalizer having a transfer function dependent on the impulse responses between the sound source locations and the soundfield sampling locations.

* * * * *